US010907471B2

(12) United States Patent
Fripp et al.

(10) Patent No.: US 10,907,471 B2
(45) Date of Patent: Feb. 2, 2021

(54) WIRELESS ACTIVATION OF WELLBORE TOOLS

(71) Applicant: Halliburton Energy Services, Inc., Houston, TX (US)

(72) Inventors: Michael Linley Fripp, Carrollton, TX (US); Zahed Kabir, Garland, TX (US); Thomas Jules Frosell, Irving, TX (US); Zachary Ryan Murphree, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/557,274

(22) Filed: Aug. 30, 2019

(65) Prior Publication Data

US 2019/0383137 A1 Dec. 19, 2019

Related U.S. Application Data

(63) Continuation of application No. 14/553,516, filed on Nov. 25, 2014, now abandoned, which is a continuation-in-part of application No. 13/907,593, filed on May 31, 2013, now Pat. No. 9,752,414.

(51) Int. Cl.

| | |
|---|---|
| ***E21B 47/13*** | (2012.01) |
| ***E21B 43/1185*** | (2006.01) |
| ***F42D 1/045*** | (2006.01) |
| ***E21B 47/12*** | (2012.01) |

(52) U.S. Cl.

CPC ..... *E21B 47/13* (2020.05); *E21B 43/1185* (2013.01); *E21B 47/12* (2013.01); *F42D 1/045* (2013.01)

(58) Field of Classification Search

CPC .. E21B 47/12; E21B 47/122; E21B 47/02216; E21B 47/0905; E21B 34/066; E21B 47/138; E21B 47/13; G01V 3/08

See application file for complete search history.

(56) References Cited

U.S. PATENT DOCUMENTS

| | | | |
|---|---|---|---|
| 2,076,308 | A | 4/1937 | Wells |
| 2,189,936 | A | 2/1940 | Brandfon |
| 2,189,937 | A | 2/1940 | Broyles |

(Continued)

FOREIGN PATENT DOCUMENTS

| | | |
|---|---|---|
| WO | 9925070 | 5/1999 |
| WO | 0220942 | 3/2002 |

(Continued)

OTHER PUBLICATIONS

Halliburton Drawing 672.03800, May 4, 1994, p. 1 of 2.

(Continued)

*Primary Examiner* — Kristyn A Hall

(74) *Attorney, Agent, or Firm* — Scott Richardson; Baker Botts L.L.P.

(57) ABSTRACT

Systems and methods are disclosed for a well tool. The well tool system includes a receiving tool disposed in a wellbore tubular. The receiving tool is configured to transition from an inactive state to an active state in response to a triggering signal. The well tool system further includes a transmitting tool at a surface and proximate to the receiving tool. The transmitting tool is configured to wirelessly transmit the triggering signal to the receiving tool.

19 Claims, 11 Drawing Sheets

(56) References Cited

U.S. PATENT DOCUMENTS 2,308,004 A 1/1943 Hart
2,330,265 A 9/1943 Burt
2,373,006 A 4/1945 Baker
2,381,929 A 8/1945 Schlumberger
2,618,340 A 11/1952 Lynd
2,618,343 A 11/1952 Conrad
2,637,402 A 5/1953 Baker et al.
2,640,547 A 6/1953 Baker et al.
2,695,064 A 11/1954 Ragan et al.
2,715,444 A 8/1955 Fewel
2,871,946 A 2/1959 Bigelow
2,918,125 A 12/1959 Sweetman
2,961,045 A 11/1960 Stogner et al.
2,974,727 A 3/1961 Goodwin
3,029,873 A 4/1962 Hanes
3,055,430 A 9/1962 Campbell
3,076,928 A 2/1963 Clay
3,122,728 A 2/1964 Walton et al.
3,160,209 A 12/1964 Bonner
3,195,637 A 7/1965 Wayte
RE25,846 E 8/1965 Campbell
3,217,804 A 11/1965 Peter
3,233,674 A 2/1966 Leutwyler
3,266,575 A 8/1966 Owen
3,398,803 A 8/1968 Leutwyler et al.
3,556,211 A 1/1971 Bohn et al.
3,659,648 A 5/1972 Cobbs
3,737,845 A 6/1973 Maroney
4,085,590 A 4/1978 Powell et al.
4,206,810 A 6/1980 Blackman
4,282,931 A 8/1981 Golben
4,352,397 A 10/1982 Christopher
4,377,209 A 3/1983 Golben
4,385,494 A 5/1983 Golben
4,402,187 A 9/1983 Golben et al.
4,598,769 A 7/1986 Robertson
4,796,699 A 1/1989 Upchurch
4,856,595 A 8/1989 Upchurch
4,884,953 A 12/1989 Golben
4,901,069 A 2/1990 Veneruso
5,024,270 A 6/1991 Bostick
5,040,602 A 8/1991 Helms
5,058,674 A 10/1991 Schultz et al.
5,074,940 A 12/1991 Ochi et al.
5,089,069 A 2/1992 Ramaswamy et al.
5,101,907 A 4/1992 Schultz et al.
5,117,548 A 6/1992 Griffith et al.
5,155,471 A 10/1992 Ellis et al.
5,163,521 A 11/1992 Pustanyk et al.
5,188,183 A 2/1993 Hopmann et al.
5,197,758 A 3/1993 Lund et al.
5,211,224 A 5/1993 Bouldin
5,238,070 A 8/1993 Schultz et al.
5,279,321 A 1/1994 Krimm
5,293,551 A 3/1994 Perkins et al.
5,316,081 A 5/1994 Baski et al.
5,316,087 A 5/1994 Manke et al.
5,355,960 A 10/1994 Schultz et al.
5,396,951 A 3/1995 Ross
5,452,763 A 9/1995 Owen
5,476,018 A 12/1995 Nakanishi et al.
5,485,884 A 1/1996 Hanley et al.
5,490,564 A 2/1996 Schultz et al.
5,531,845 A 7/1996 Flanigan et al.
5,558,153 A 9/1996 Holcombe et al.
5,573,307 A 11/1996 Wilkinson et al.
5,575,331 A 11/1996 Terrell
5,622,211 A 4/1997 Martin et al.
5,662,166 A 9/1997 Shammai
5,673,556 A 10/1997 Golben et al.
5,687,791 A 11/1997 Beck et al.
5,700,974 A 12/1997 Taylor
5,725,699 A 3/1998 Hinshaw et al.
5,971,072 A 10/1999 Huber et al.
6,021,095 A 2/2000 Tubel
6,061,000 A 5/2000 Edwards
6,128,904 A 10/2000 Rosso, Jr. et al.
6,137,747 A 10/2000 Shah et al.
6,160,492 A 12/2000 Herman
6,172,614 B1 1/2001 Robison et al.
6,186,226 B1 2/2001 Robertson
6,196,584 B1 3/2001 Shirk et al.
6,244,340 B1 6/2001 McGlothen et al.
6,315,043 B1 11/2001 Farrant et al.
6,333,699 B1 12/2001 Zierolf
6,364,037 B1 4/2002 Brunnert et al.
6,378,611 B1 4/2002 Helderle
6,382,234 B1 5/2002 Birckhead et al.
6,438,070 B1 8/2002 Birchak et al.
6,450,258 B2 9/2002 Green et al.
6,450,263 B1 9/2002 Schewendemann
6,470,996 B1 10/2002 Kyle et al.
6,536,524 B1 3/2003 Snider
6,561,479 B1 5/2003 Eldridge
6,568,470 B2 5/2003 Goodson, Jr. et al.
6,583,729 B1 6/2003 Gardner et al.
6,584,911 B2 7/2003 Bergerson et al.
6,598,679 B2 7/2003 Robertson
6,619,388 B2 9/2003 Dietz et al.
6,651,747 B2 11/2003 Chen et al.
6,668,937 B1 12/2003 Murray
6,672,382 B2 1/2004 Schultz et al.
6,695,061 B2 2/2004 Fripp et al.
6,705,425 B2 3/2004 West
6,717,283 B2 4/2004 Skinner et al.
6,776,255 B2 8/2004 West et al.
6,848,503 B2 2/2005 Schultz et al.
6,880,634 B2 4/2005 Gardner et al.
6,915,848 B2 7/2005 Thomeer et al.
6,925,937 B2 8/2005 Robertson
6,971,449 B1 12/2005 Robertson
6,973,993 B2 12/2005 West et al.
6,998,999 B2 2/2006 Fripp et al.
7,012,545 B2 3/2006 Skinner et al.
7,063,146 B2 6/2006 Schultz et al.
7,063,148 B2 6/2006 Jabusch
7,068,183 B2 6/2006 Shah et al.
7,082,078 B2 7/2006 Fripp et al.
7,083,009 B2 8/2006 Paluch et al.
7,104,276 B2 9/2006 Einhaus
7,152,657 B2 12/2006 Bosma et al.
7,152,679 B2 12/2006 Simpson
7,165,608 B2 1/2007 Schultz et al.
7,191,672 B2 3/2007 Ringgenberg et al.
7,195,067 B2 3/2007 Manke et al.
7,197,923 B1 4/2007 Wright et al.
7,199,480 B2 4/2007 Fripp et al.
7,201,230 B2 4/2007 Schultz et al.
7,210,555 B2 5/2007 Shah et al.
7,234,519 B2 6/2007 Fripp et al.
7,237,616 B2 7/2007 Patel
7,246,659 B2 7/2007 Fripp et al.
7,246,660 B2 7/2007 Fripp et al.
7,252,152 B2 8/2007 LoGiudice et al.
7,258,169 B2 8/2007 Fripp et al.
7,301,472 B2 11/2007 Kyle et al.
7,301,473 B2 11/2007 Shah et al.
7,322,416 B2 1/2008 Burris, II et al.
7,325,605 B2 2/2008 Fripp et al.
7,337,852 B2 3/2008 Manke et al.
7,339,494 B2 3/2008 Shah et al.
7,363,967 B2 4/2008 Burris, II et al.
7,367,394 B2 5/2008 Villareal et al.
7,372,263 B2 5/2008 Edwards
7,373,944 B2 5/2008 Smith et al.
7,387,165 B2 6/2008 Lopez de Cardenas et al.
7,395,882 B2 7/2008 Oldham et al.
7,398,996 B2 7/2008 Saito et al.
7,404,416 B2 7/2008 Schultz et al.
7,428,922 B2 9/2008 Fripp et al.
7,431,335 B2 10/2008 Khandhadia et al.
7,472,589 B2 1/2009 Irani et al.
7,472,752 B2 1/2009 Rogers et al.
7,508,734 B2 3/2009 Fink et al.

(56) References Cited

U.S. PATENT DOCUMENTS 7,510,017 B2 3/2009 Howell et al.
7,557,492 B2 7/2009 Fripp et al.
7,559,363 B2 7/2009 Howell et al.
7,559,373 B2 7/2009 Jackson et al.
7,595,737 B2 9/2009 Fink et al.
7,596,995 B2 10/2009 Irani et al.
7,604,062 B2 10/2009 Murray
7,610,964 B2 11/2009 Cox
7,617,871 B2 11/2009 Surjaatmadja et al.
7,624,792 B2 12/2009 Wright et al.
7,640,965 B2 1/2010 Bosma et al.
7,665,355 B2 2/2010 Zhang et al.
7,669,661 B2 3/2010 Johnson
7,673,506 B2 3/2010 Irani et al.
7,673,673 B2 3/2010 Surjaatmadja et al.
7,699,101 B2 4/2010 Fripp et al.
7,699,102 B2 4/2010 Storm et al.
7,712,527 B2 5/2010 Roddy
7,717,167 B2 5/2010 Storm et al.
7,730,954 B2 6/2010 Schultz et al.
7,777,645 B2 8/2010 Shah et al.
7,781,939 B2 8/2010 Fripp et al.
7,802,627 B2 9/2010 Hofman et al.
7,804,172 B2 9/2010 Schultz et al.
7,832,474 B2 11/2010 Nguy
7,836,952 B2 11/2010 Fripp
7,856,872 B2 12/2010 Irani et al.
7,878,255 B2 2/2011 Howell et al.
7,946,166 B2 5/2011 Irani et al.
7,946,340 B2 5/2011 Surjaatmadja et al.
7,963,331 B2 6/2011 Surjaatmadja et al.
7,987,914 B2 8/2011 Benton
8,040,249 B2 10/2011 Shah et al.
8,091,637 B2 1/2012 Fripp
8,118,098 B2 2/2012 Hromas et al.
8,140,010 B2 3/2012 Symons et al.
8,146,673 B2 4/2012 Howell et al.
8,162,050 B2 4/2012 Roddy et al.
8,191,627 B2 6/2012 Hamid et al.
8,196,515 B2 6/2012 Streibich et al.
8,196,653 B2 6/2012 Fripp et al.
8,215,404 B2 7/2012 Makowiecki et al.
8,220,545 B2 7/2012 Storm, Jr. et al.
8,225,014 B2 7/2012 Kuhl
8,235,103 B2 8/2012 Wright et al.
8,235,128 B2 8/2012 Dykstra et al.
8,240,384 B2 8/2012 Miller et al.
8,261,839 B2 9/2012 Fripp et al.
8,276,669 B2 10/2012 Dykstra et al.
8,276,675 B2 10/2012 Williamson et al.
8,284,075 B2 10/2012 Fincher et al.
8,297,367 B2 10/2012 Chen et al.
8,302,681 B2 11/2012 Fripp et al.
8,319,657 B2 11/2012 Godager
8,322,426 B2 12/2012 Wright et al.
8,327,885 B2 12/2012 Dykstra et al.
8,356,668 B2 1/2013 Dykstra et al.
8,376,047 B2 2/2013 Dykstra et al.
8,387,662 B2 3/2013 Dykstra et al.
8,397,803 B2 3/2013 Crabb et al.
8,403,068 B2 3/2013 Robison et al.
8,432,167 B2 4/2013 Reiderman
8,459,377 B2 6/2013 Moyes
8,472,282 B2 6/2013 Fink et al.
8,474,533 B2 7/2013 Miller et al.
8,479,831 B2 7/2013 Dykstra et al.
8,505,639 B2 8/2013 Robison et al.
8,517,113 B2 8/2013 Sheffield
8,544,564 B2 10/2013 Moore et al.
8,555,975 B2 10/2013 Dykstra et al.
8,584,762 B2 11/2013 Fripp et al.
8,602,100 B2 12/2013 Dykstra et al.
8,607,863 B2 12/2013 Fripp
8,616,276 B2 12/2013 Tips et al.
8,616,290 B2 12/2013 Dykstra et al.
8,622,136 B2 1/2014 Dykstra et al.
8,636,062 B2 1/2014 Fripp et al.
8,708,056 B2 4/2014 Helms et al.
8,973,657 B2 3/2015 Miller et al.
8,991,486 B2 3/2015 Acosta et al.
9,010,442 B2 4/2015 Streich et al.
9,169,705 B2 10/2015 Helms et al.
9,284,817 B2 3/2016 Walton et al.
9,366,134 B2 6/2016 Walton et al.
9,562,429 B2 2/2017 Walton et al.
9,587,486 B2 3/2017 Walton et al.
9,587,487 B2 3/2017 Walton et al.
9,752,414 B2 9/2017 Fripp et al.
2002/0038849 A1 4/2002 Adolph et al.
2002/0048135 A1 4/2002 Lerche et al.
2003/0213595 A1 11/2003 Jackson
2004/0108114 A1 6/2004 Lerche et al.
2004/0156264 A1 8/2004 Gardner et al.
2004/0227509 A1 11/2004 Ucan
2004/0238166 A1* 12/2004 Salamitou ..... E21B 49/00 166/255.1
2005/0241835 A1 11/2005 Burris, II et al.
2005/0260468 A1 11/2005 Fripp et al.
2005/0269083 A1 12/2005 Burris, II et al.
2006/0118303 A1 6/2006 Schultz et al.
2006/0144590 A1 7/2006 Lopez de Cardenas et al.
2007/0189452 A1 8/2007 Johnson et al.
2008/0135248 A1 6/2008 Talley et al.
2008/0137481 A1 6/2008 Shah et al.
2008/0202766 A1 8/2008 Howell et al.
2009/0192731 A1 7/2009 De Jesus et al.
2009/0308588 A1 12/2009 Howell et al.
2010/0065125 A1 3/2010 Telfer
2010/0084060 A1 4/2010 Hinshaw et al.
2010/0175867 A1 7/2010 Wright
2010/0201352 A1 8/2010 Englert
2011/0042092 A1 2/2011 Fripp et al.
2011/0168390 A1 7/2011 Fripp et al.
2011/0174484 A1 7/2011 Wright et al.
2011/0174504 A1 7/2011 Wright et al.
2011/0199859 A1 8/2011 Fink et al.
2011/0214853 A1 9/2011 Robichaux et al.
2011/0248566 A1 10/2011 Purkis
2011/0253383 A1 10/2011 Porter et al.
2011/0266001 A1 11/2011 Dykstra et al.
2011/0308806 A9 12/2011 Dykstra et al.
2012/0001629 A1 1/2012 Hopper et al.
2012/0018167 A1 1/2012 Konopczynski et al.
2012/0048531 A1 3/2012 Marzouk et al.
2012/0075113 A1 3/2012 Loi et al.
2012/0111577 A1 5/2012 Dykstra et al.
2012/0146805 A1 6/2012 Vick, Jr. et al.
2012/0179428 A1 7/2012 Dykstra et al.
2012/0186819 A1 7/2012 Dagenais et al.
2012/0205120 A1 8/2012 Howell
2012/0205121 A1 8/2012 Porter et al.
2012/0211243 A1 8/2012 Dykstra et al.
2012/0234557 A1 9/2012 Dykstra et al.
2012/0241143 A1 9/2012 Wright et al.
2012/0255739 A1 10/2012 Fripp et al.
2012/0255740 A1 10/2012 Fripp et al.
2012/0279593 A1 11/2012 Fripp et al.
2012/0313790 A1 12/2012 Heijnen et al.
2012/0318511 A1 12/2012 Dykstra et al.
2012/0318526 A1 12/2012 Dykstra et al.
2013/0000922 A1 1/2013 Skinner et al.
2013/0014940 A1 1/2013 Fripp et al.
2013/0014941 A1 1/2013 Tips et al.
2013/0014955 A1 1/2013 Fripp et al.
2013/0020090 A1 1/2013 Fripp et al.
2013/0048290 A1 2/2013 Howell et al.
2013/0048291 A1 2/2013 Merron et al.
2013/0048298 A1 2/2013 Merron et al.
2013/0048301 A1 2/2013 Gano et al.
2013/0075107 A1 3/2013 Dykstra et al.
2013/0092382 A1 4/2013 Dykstra et al.
2013/0092393 A1 4/2013 Dykstra et al.
2013/0098614 A1 4/2013 Dagenais et al.
2013/0106366 A1 5/2013 Fripp et al.

(56) References Cited

U.S. PATENT DOCUMENTS

| | | | |
|---|---|---|---|
| 2013/0112423 | A1 | 5/2013 | Dykstra et al. |
| 2013/0112424 | A1 | 5/2013 | Dykstra et al. |
| 2013/0112425 | A1 | 5/2013 | Dykstra et al. |
| 2013/0122296 | A1 | 5/2013 | Rose et al. |
| 2013/0140038 | A1 | 6/2013 | Fripp et al. |
| 2013/0153238 | A1 | 6/2013 | Fripp et al. |
| 2013/0180727 | A1 | 7/2013 | Dykstra et al. |
| 2013/0180732 | A1 | 7/2013 | Acosta et al. |
| 2013/0186634 | A1 | 7/2013 | Fripp et al. |
| 2013/0192829 | A1 | 8/2013 | Fadul et al. |
| 2013/0264053 | A1 | 10/2013 | Miller et al. |
| 2013/0284432 | A1 | 10/2013 | Macphail et al. |
| 2014/0102807 | A1 | 4/2014 | Zhao et al. |
| 2014/0131035 | A1 | 5/2014 | Entchev et al. |
| 2014/0238666 | A1 | 8/2014 | Walton et al. |
| 2014/0262234 | A1 | 9/2014 | Walton et al. |
| 2014/0262237 | A1 | 9/2014 | Walton et al. |
| 2014/0262320 | A1 | 9/2014 | Walton et al. |
| 2014/0262321 | A1 | 9/2014 | Fripp et al. |
| 2014/0262502 | A1 | 9/2014 | Walton et al. |
| 2014/0266772 | A1 | 9/2014 | Walton et al. |
| 2014/0352981 | A1 | 12/2014 | Walton et al. |

FOREIGN PATENT DOCUMENTS

| | | |
|---|---|---|
| WO | 2004/018833 | 3/2004 |
| WO | 2004/099564 | 11/2004 |
| WO | 2009/109788 | 9/2009 |
| WO | 2010/002270 | 1/2010 |
| WO | 2010/111076 | 9/2010 |
| WO | 2011/021053 | 2/2011 |
| WO | 2011/087721 | 7/2011 |
| WO | 2012/078204 | 6/2012 |
| WO | 2012/082248 | 6/2012 |
| WO | 2012/161854 | 11/2012 |
| WO | 2013/032687 | 3/2013 |
| WO | 2014/092836 | 6/2014 |
| WO | 2014/130052 | 8/2014 |
| WO | 2014/130053 | 8/2014 |
| WO | 2014/163821 | 9/2014 |
| WO | 2014/193833 | 12/2014 |

OTHER PUBLICATIONS

Halliburton Drawing 672.03800, May 4, 1994, p. 2 of 2.

Halliburton Drawing 626.02100, Apr. 20, 1999; 2 pages.

National Instruments, Jan. 3, 2003 "What determines if a Transducer is Active or Passive?", http://digital.nl.com/public.nsf/allkb/084702CE98679BB886256CA3006752D7.

Magneta Electromagnetic Cluthes and Brakes catalog, Jan. 2004, 28 pages, Magneta GmbH & Co KG.

Ward, Matt, et al., "RFID: Frequency, standards, adoption and innovation," JISC Technology and Standards Watch, May 2006, pp. 1-36.

Halliburton brochure entitled "Armada™ Sampling System," Sep. 2007; 2 pages.

Paus, Annika, "Near Field Communication in Cell Phones," Jul. 24, 2007, pp. 1-22 plus 1 cover and 1 content pages.

Sanni, Modiu L., et al., "Reservoir Nanorobots," Saudi Aramco Journal of Technology, Spring 2008, pp. 44-52.

Danaher product information, Motion Brakes, http://www.danahermotion.com/website/usa/eng/products/cluthes_and_brakes/115836.php, Mar. 4, 2009, 3 pages, Danaher Motion.

Ogura product information, "Electromagnetic Clutch/Brake," http://www.ogura-clutch.com/products.html?category=2&by=type&no=1, Mar. 4, 2009, 4 pages, Ogura Industrial Corp.

Office Action dated Dec. 24, 2012 (26 pages), U.S. Appl. No. 12/688,058, filed Jan. 15, 2010.

Foreign communication from a related counterpart application—International Search Report and Written Opinion, PCT/US2010/061047, dated Jun. 23, 2011; 7 pages.

Foreign communication from a related counterpart application—International Search Report and Written Opinion, PCT/US2011/036686, dated Nov. 30, 2011; 8 pages.

Office Action dated Dec. 22, 2011 (30 pages), U.S. Appl. No. 12/965,859, filed Dec. 11, 2010.

Office Action dated Dec. 23, 2011 (34 pages), U.S. Appl. No. 12/688,058, filed Jan. 15, 2010.

Filing Receipt and specification for patent application entitled "Remotely Activated Down Hole Systems and Methods," by Frank V. Acosta, et al., filed Mar. 7, 2012 as U.S. Appl. No. 13/414,016.

Filing Receipt and Specification for patent application entitled "External Casing Packer and Method of Performing Cementing Job," by Lonnie Helms et al., filed Mar. 7, 2012 as U.S. Appl. No. 13/414,140.

Foreign communication from a related counterpart application—International Preliminary Report on Patentability, PCT/US2010/061047, Jul. 17, 2012; 5 pages.

Filing Receipt and Specification for patent application entitled "Method of Completing a Multi-Zone Fracture Stimulation Treatment of a Wellbore," by Steven G. Streich et al., filed Sep. 21, 2012 as U.S. Appl. No. 13/624,173.

Filing Receipt and Specification for patent application entitled "Pressure Relief-Assisted Packer," by Lonnie Carl Helms et al., filed Oct. 25, 2012 as U.S. Appl. No. 13/660,678.

Filing Receipt and specification for international application entitled "Pressure Equalization for Dual Seat Ball Valve," filed Feb. 25, 2013 as International application No. PCT/US2013/027666.

Filing Receipt and specification for international application entitled "Autofill and Circulation Assembly and Method of Using the Same," filed Feb. 25, 2013 as International application No. PCT/US2013/027674.

Filing Receipt and specification for patent application entitled "Method and Apparatus for Magnetic Pulse Signature Actuation," by Zachary W. Walton, et al., filed Feb. 28, 2013 as U.S. Appl. No. 13/781,093.

Foreign communication from a related counterpart application—International Search Report and Written Opinion, PCT/US2012/050762, dated Mar. 11, 2013; 12 pages.

Filing Receipt and specification for provisional patent application entitled "Wellbore Servicing Tools, Systems and Methods Utilizing Near-Field Communication," by Zachary William Walton, et al., filed Mar. 12, 2013 as U.S. Appl. No. 61/778,312.

Filing Receipt and specification for patent application entitled "Dual Magnetic Sensor Actuation Assembly," by Zachary W. Walton, et al., filed Mar. 14, 2013 as U.S. Appl. No. 13/828,824.

Filing Receipt and Specification for patent application entitled "Wellbore Servicing Tools, Systems and Methods Utilizing Near-Field Communication," by Zachery William Walton et al., filed Jun. 10, 2013 as U.S. Appl. No. 13/913,881.

Filing Receipt and Specification for patent application entitled "Wellbore Servicing Tools, Systems and Methods Utilizing Near-Field Communication," by Zachery William Walton et al., filed Jun. 10, 2013 as U.S. Appl. No. 13/914,114.

Filing Receipt and Specification for patent application entitled "Wellbore Servicing Tools, Systems and Methods Utilizing Near-Field Communication," by Zachery William Walton et al., filed Jun. 10, 2013 as U.S. Appl. No. 13/914,177.

Filing Receipt and Specification for patent application entitled "Wellbore Servicing Tools, Systems and Methods Utilizing Near-Field Communication," by Zachery William Walton et al., filed Jun. 10, 2013 as U.S. Appl. No. 13/914,104.

Filing Receipt and Specification for patent application entitled "Wellbore Servicing Tools, Systems and Methods Utilizing Near-Field Communication," by Zachery William Walton et al., filed Jun. 10, 2013 as U.S. Appl. No. 13/914,216.

Filing Receipt and Specification for patent application entitled "Wellbore Servicing Tools, Systems and Methods Utilizing Near-Field Communication," by Zachery William Walton et al., filed Jun. 10, 2013 as U.S. Appl. No. 13/914,238.

Foreign communication from a related counterpart application—International Preliminary Report on Patentability, PCT/US2011/036686, dated Jun. 12, 2013; 5 pages.

(56) References Cited

OTHER PUBLICATIONS

Office Action dated Sep. 19, 2013, U.S. Appl. No. 12/688,058, filed Jan. 15, 2010; 17 pages.
Office Action dated Sep. 19, 2013, U.S. Appl. No. 12/965,859, filed Dec. 11, 2010; 30 pages.
Office Action dated Dec. 3, 2013, U.S. Appl. No. 13/905,859, filed May 30, 2013; 46 pages.
Foreign communication from a related counterpart application—Australian Office Action, AU Application No. 2010341610, dated Feb. 27, 2014; 5 pages.
Office Action (Final) dated Mar. 10, 2014, U.S. Appl. No. 12/688,058, filed Jan. 15, 2010; 13 pages.
Foreign communication from a related counterpart application—International Search Report and Written Opinion, PCT/US2013/061386, dated Apr. 10, 2014; 12 pages.
Office Action (Final) dated May 9, 2014, U.S. Appl. No. 12/965,859, filed Dec. 11, 2010; 16 pages.
Advisory Action dated Jul. 1, 2014, U.S. Appl. No. 12/688,058, filed Jan. 15, 2010; 3 pages.
Notice of Allowance dated Jul. 15, 2014, U.S. Appl. No. 12/688,058, filed Jan. 15, 2010; 28 pages.
Office Action (Final) dated Jul. 22, 2014, U.S. Appl. No. 13/905,859, filed May 30, 2013; 21 pages.
International Search Report and Written Opinion in related PCT Application No. PCT/US2014/039569, dated Jul. 16, 2015; 17 pages.
International Preliminary Report on Patentability issued in related PCT Application No. PCT/US2014/039569 dated Dec. 10, 2015; 11 pages.
International Search Report and Written Opinion, Application No. PCT/US2014/067291; 15 pgs. dated Jul. 29, 2015.
International Preliminary Report on Patentability issued in related PCT Application No. PCT/US2014/067291 dated Jun. 8, 2017; 12 pages.
Examination Report, Australian Application No. 2014412711, dated Nov. 3, 2017; 3 pages.
Examination Report, Australian Application No. 2014412711, dated Feb. 13, 2018; 3 pages.

* cited by examiner

WIRELESS ACTIVATION OF WELLBORE TOOLS

CROSS-REFERENCE TO RELATED APPLICATION

This application is a Continuation of U.S. patent application Ser. No. 14/553,516 filed Nov. 25, 2014, which is a continuation-in-part of U.S. patent application Ser. No. 13/907,593 filed on May 31, 2013, now U.S. Pat. No. 9,752,414.

TECHNICAL FIELD

The present disclosure relates generally to downhole tools and, more particularly, to wireless activation of downhole tools.

BACKGROUND

Hydrocarbon-producing wells often are stimulated by hydraulic fracturing operations, wherein a servicing fluid such as a fracturing fluid or a perforating fluid may be introduced into a portion of a subterranean formation penetrated by a wellbore at a hydraulic pressure sufficient to create or enhance at least one fracture therein. Such a subterranean formation stimulation treatment may increase hydrocarbon production from the well.

In the performance of such a stimulation treatment and/or in the performance of one or more other wellbore operations (e.g., a drilling operation, a completion operation, a fluid-loss control operation, a cementing operation, production, or combinations thereof), it may be necessary to selectively manipulate one or more tools which will be utilized in such operations. However, tools conventionally employed in such wellbore operations are limited in their manner of usage and may be inefficient due to power consumption limitations. Moreover, tools conventionally employed may be limited as to their useful life and/or duration of use because of power availability limitations. As such, there exists a need for improved tools for use in wellbore operations and for methods and system of using such tools.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

Figure 2:
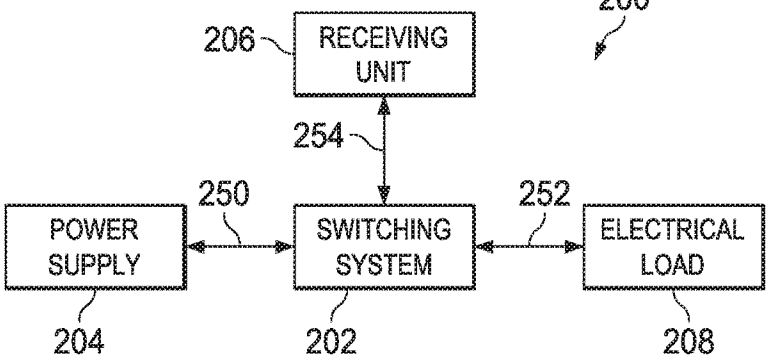
FIG. 2 is a block diagram view of an electronic circuit comprising a switching system.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the present disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is not intended to limit the present disclosure to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are one or more embodiments of wellbore servicing systems and wellbore servicing methods to activate a tool, for example, upon the communication of one or more triggering signals from a first tool (e.g., a transmitting tool) to a second tool (e.g., a receiving tool), for example, within a wellbore environment. In some embodiments, the one or more triggering signals may be effective to activate (e.g., to switch "on") one or more tools utilizing a wireless switch, as will be disclosed herein, for example, the triggering signal may be effective to induce a response within the wireless switch so as to transition such a tool from a configuration in which no electrical or electronic component associated with the tool receives power from a power source associated with the tool to a configuration in which one or more electrical or electronic components receive electrical power from the power source. Also disclosed herein are one or more embodiments of tools that may be employed in such wellbore servicing systems and/or wellbore servicing methods utilizing a wireless switch.

Figure 1A:
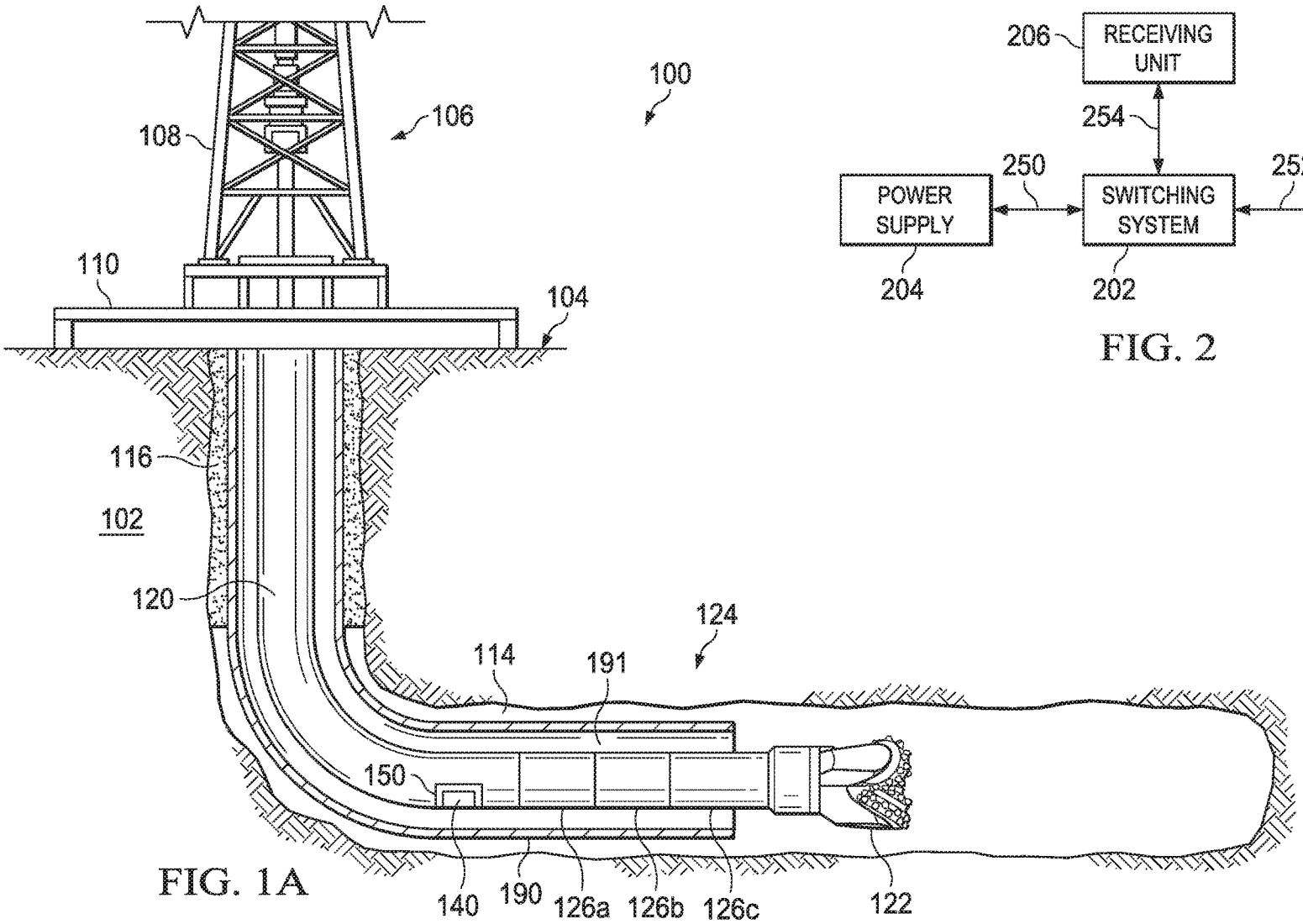
FIG. 1A is a representative partially cross-sectional view of a well system.

FIG. 1A is a representative partially cross-sectional view of a well system 100. It is noted that although some of the figures may exemplify horizontal or vertical wellbores, the principles of the methods, apparatuses, and systems disclosed herein may be similarly applicable to horizontal wellbore configurations, conventional vertical wellbore configurations, and combinations thereof. Therefore, the horizontal or vertical nature of any figure is not to be construed as limiting the wellbore to any particular configuration.

Referring to FIG. 1A, the operating environment generally comprises a drilling or servicing rig 106 that is positioned on the earth's surface 104 and extends over and around a wellbore 114 that penetrates a subterranean formation 102, for example, for the purpose of recovering hydrocarbons from the subterranean formation 102, disposing of carbon dioxide within the subterranean formation 102, injecting stimulation fluids within the subterranean formation 102, or combinations thereof. The wellbore 114 may be drilled into the subterranean formation 102 by any suitable drilling technique. In some embodiments, the drilling or servicing rig 106 comprises a derrick 108 with a rig floor 110 through which a casing 190 (e.g., a completion string or liner) generally defining an axial flowbore 191 may be positioned within the wellbore 114. The drilling or servicing rig 106 may be conventional and may comprise a motor driven winch and other associated equipment for lowering a tubular, such as the casing 190 into the wellbore 114, for example, so as to position the completion equipment at the desired depth.

While the operating environment depicted in FIG. 1A refers to a stationary drilling or servicing rig 106 and a land-based wellbore 114, one of ordinary skill in the art will readily appreciate that mobile workover rigs, wellbore completion units (e.g., coiled tubing units), offshore platforms, drill ships, semi-submersibles, and/or drilling barges may be similarly employed. One of ordinary skill in the art will also readily appreciate that the systems, methods, tools, and/or devices disclosed herein may be employed within other operational environments, such as within an offshore wellbore operational environment.

The well system 100 may include a drill string 120 associated with a drill bit 122 that may be used to form a wide variety of wellbores or bore holes such as the wellbore 114. The drill string 120 may include various components of a bottom hole assembly (BHA) 124 that may also be used to form a wellbore 114.

The BHA 124 may be formed from a wide variety of components configured to form a wellbore 114. For example, components 126*a*, 126*b* and 126*c* of a BHA 124 may include, but are not limited to, drill bits (e.g., drill bit 122) drill collars, rotary steering tools, directional drilling tools, downhole drilling motors, drilling parameter sensors for weight, torque, bend and bend direction measurements of the drill string and other vibration and rotational related sensors, hole enlargers such as reamers, under reamers or hole openers, stabilizers, measurement while drilling (MWD) components containing wellbore survey equipment, logging while drilling (LWD) sensors for measuring formation parameters, short-hop and long haul telemetry systems used for communication, and/or any other suitable downhole equipment. The number of components such as drill collars and different types of components 126 included in the BHA 124 may depend upon anticipated downhole drilling conditions and the type of wellbore that will be formed by the drill string 120 and the rotary drill bit 122. The BHA 124 may also include various types of well logging tools (not expressly shown) and other downhole tools associated with directional drilling of a wellbore. Examples of such logging tools and/or directional drilling tools may include, but are not limited to, acoustic, neutron, gamma ray, density, photoelectric, nuclear magnetic resonance, rotary steering tools and/or any other commercially available tool.

In some embodiments, the wellbore 114 may extend substantially vertically away from the earth's surface 104 over a vertical wellbore portion, or may deviate at any angle from the earth's surface 104 over a deviated or horizontal wellbore portion. In other operating environments, portions or substantially all of the wellbore 114 may be vertical, deviated, horizontal, and/or curved.

In some embodiments, at least a portion of the casing 190 may be secured into position against the formation 102 in a conventional manner using cement 116. Additionally, at least a portion of the casing 190 may be secured into position with a packer, for example a mechanical or swellable packer (such as SwellPackers™, commercially available from Halliburton Energy Services). In some embodiments, the wellbore 114 may be partially completed (e.g., partially cased and cemented) thereby resulting in a portion of the wellbore 114 being uncompleted (e.g., uncased and/or uncemented) or the wellbore may be uncompleted. Portions of wellbore 114 as shown in FIG. 1A that do not include casing 190 may be described as "open hole."

It is noted that although the environment illustrated with respect to FIG. 1A illustrates a casing 190 disposed within the wellbore 114, in one or more embodiments, any other suitable wellbore tubular such as a casing string, a work string, a liner, a drilling string, a coiled tubing string, a jointed tubing string, the like, or combinations thereof, may additionally be disposed within the wellbore 114.

In some embodiments, as will be disclosed herein, one or more tools may be incorporated within the casing 190. For example, in some embodiments, one or more selectively actuatable wellbore stimulation tools (e.g., fracturing tools), selectively actuatable wellbore isolation tools, or the like may be incorporated within the casing 190. Additionally, in some embodiments, one or more other wellbore servicing tools (e.g., a sensor, a logging device, an inflow control device, the like, or combinations thereof) may be similarly incorporated within the casing 190.

In the same or other embodiments, a drill string 120 may include tools 140. The tools 140 may be located partially or completely inside a drill string 120. The tools 140 may be installed directly in a drill string 120, or may be installed in a housing 150 and the housing 150 may be installed in the drill string 120. The tools 140 may include sensors, actuators, telemetry devices, data recorders, or any other suitable device operated by a power supply proximate to the device. For example, the tools 140 may include pressure sensors configured to detect the pressure at any suitable location on the drill string 120. The tools 140 may be included in the BHA 124, the drill bit 122, or at any other suitable location along the drill string 120. The tools 140 may be mechanically enclosed in a housing and sealed inside the drill string 120. For example, the tools 140 may be installed in the drill string 120 and the drill string 120 may be welded shut, which may substantially prevent further direct physical manipulation of the tools 140.

Figure 1B:
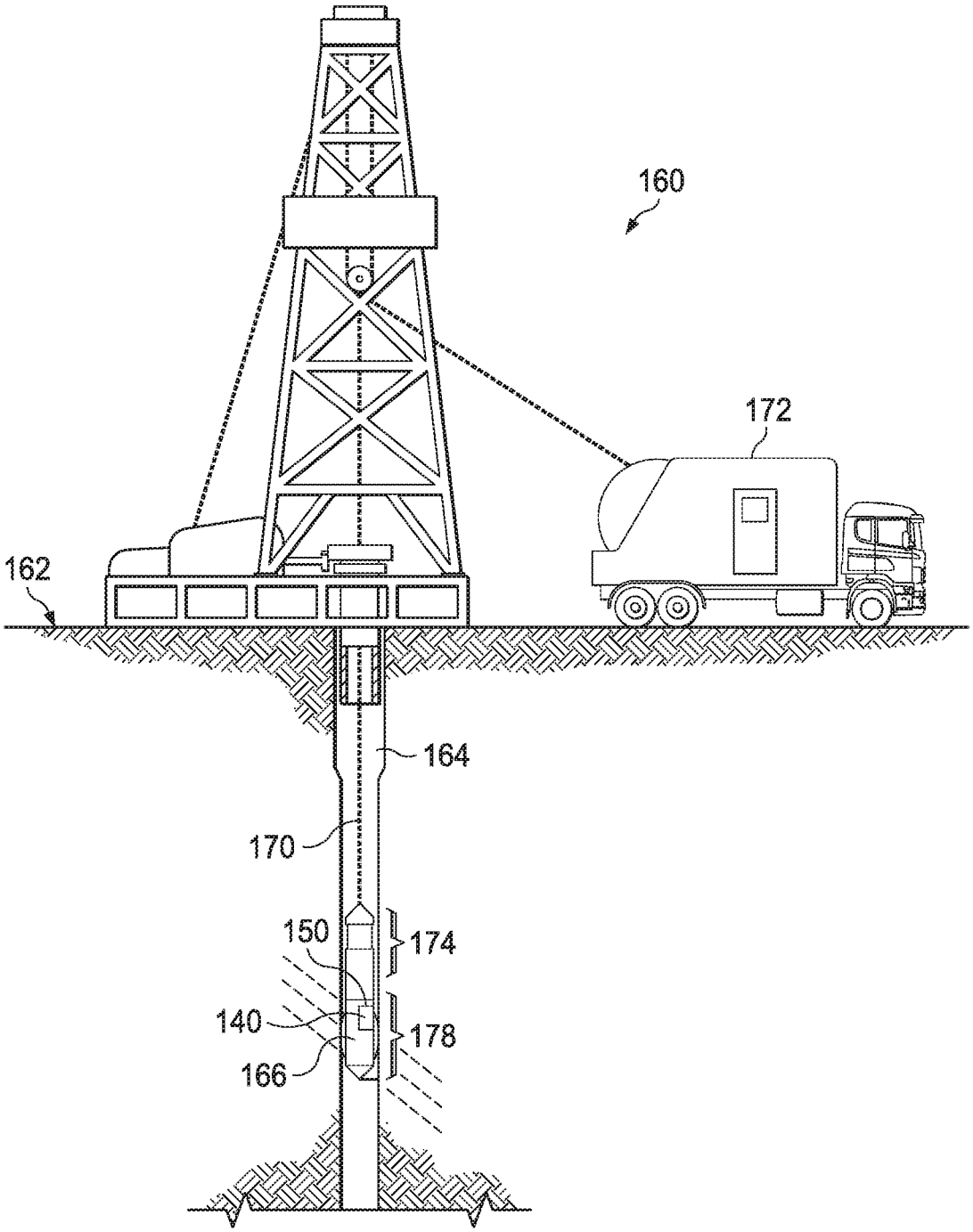
FIG. 1B is a representative partially cross-sectional view of a well system utilizing a wireline system.

Embodiments of the present disclosure may additionally be utilized in a wireline well system. Accordingly, FIG. 1B is a representative partially cross-sectional view of a well system 160 utilizing a wireline system 166. Modern hydrocarbon drilling and production operations may use conveyances such as ropes, wires, lines, tubes, or cables (hereinafter "line") to suspend a downhole tool in a wellbore. Although FIG. 1B shows land-based equipment, downhole tools incorporating teachings of the present disclosure may be satisfactorily used with equipment located on offshore platforms, drill ships, semi-submersibles, and drilling barges (not expressly shown). Additionally, while the wellbore 164 is shown as being a generally vertical wellbore, the wellbore 164 may be any orientation including generally horizontal, multilateral, or directional.

Subterranean operations may be conducted using a wireline system 166 including one or more downhole tools 168 that may be suspended in the wellbore 164 from the line 170. The line 170 may be any type of conveyance, such as a rope, cable, line, tube, or wire which may be suspended in the wellbore 164. In some embodiments, the line 170 may be a single strand of conveyance. In other embodiments, the line 170 may be a compound or composite line made of multiple strands of conveyance woven or braided together. The line 170 may be compound when a stronger line is required to support the downhole tool 168 or when multiple strands are required to carry different types of power, signals, and/or data. As one example of a compound line, the line 170 may include multiple fiber optic cables braided together and the cables may be coated with a protective coating. In another embodiment, the line 170 may be a slickline. In a further embodiment, the line 170 may be a hollow line or a line containing a sensitive core, such as a sensitive data transmission line. During a wireline operation, downhole tool 168 may be coupled to line 170 by rope socket 174. Line 170 may terminate at rope socket 174 and downhole tool 168 may be coupled to rope socket 174 at a connector.

The line 170 may include one or more conductors for transporting power, data, and/or signals to the wireline system 166 and/or telemetry data from the downhole tool 168 to a logging facility 172. Alternatively, the line 170 may lack a conductor, as is often the case using slickline or coiled tubing, and the wireline system 166 may include a control unit that includes memory, one or more batteries, and/or one or more processors for performing operations to control the downhole tool 168 and for storing measurements. The logging facility 172 (shown in FIG. 1B as a truck, although it may be any other structure) may collect measurements from the downhole tool 168, and may include computing facilities for controlling the downhole tool 168, processing the measurements gathered by the downhole tool 168, or storing the measurements gathered by the downhole tool 168. The computing facilities may be communicatively coupled to the downhole tool 168 by way of the line 170. While the logging facility 172 is shown in FIG. 1B as being onsite, the logging facility 172 may be located remote from the well surface 162 and the wellbore 164.

In the same or other embodiments, a wireline system 166 may include tools 140. The tools 140 may be located partially or completely inside a wireline system 166. The tools 140 may be installed directly in a wireline system 166, or may be installed in a housing 150 and the housing 150 may be installed in the wireline system 166. The tools 140 may include sensors, actuators, telemetry devices, data recorders, or any other suitable device operated by a power supply proximate to the device. For example, the tools 140 may include pressure sensors configured to detect the pressure at any suitable location on the wireline system 166. The tools 140 may be included in the downhole tool 168 or at any other suitable location along the wireline system 166. The tools 140 may be mechanically enclosed in a housing and sealed inside the wireline system 166. For example, the tools 140 may be installed in the wireline system 166 and the wireline system 166 may be welded shut, which may substantially prevent further direct physical manipulation of the tools 140.

Although discussed in FIGS. 1A and 1B with reference to the tools 140 being installed in a drill string 120 or a wireline system 166, the tools 140 may be installed in any "wellbore tubular" component including, but not limited to, production tubing, a casing, a riser, a completion string, a lubricator, or any other suitable wellbore component.

In some embodiments, a tool may be configured as a transmitting tool, that is, such that the transmitting tool is configured to transmit a triggering signal to one or more other tools (e.g., a receiving tool). For example, a transmitting tool may comprise a transmitter system, as will be disclosed herein. As another example, a tool may be configured as a receiving tool, that is, such that the receiving tool is configured to receive a triggering signal from another tool (e.g., a transmitting tool). For example, a receiving tool may comprise a receiver system, as will be disclosed herein. Further, a tool may be configured as a transceiver tool, that is, such that the transceiver tool (e.g., a transmitting/receiving tool) is configured to both receive a triggering signal and to transmit a triggering signal. For example, the transceiver tool may comprise a receiver system and a transmitter system, as will be disclosed herein.

In some embodiments, as will be disclosed herein, a transmitting tool may be configured to transmit a triggering signal to a receiving tool and, similarly, a receiving tool may be configured to receive the triggering signal, particularly, to passively receive the triggering signal. For example, in some embodiments, upon receiving the triggering signal, the receiving tool may be transitioned from an inactive state to an active state. In such an inactive state, a circuit associated with the tool is incomplete and any route of electrical current flow between a power supply associated with the tool and an electrical load associated with the tool is disallowed (e.g., no electrical or electronic component associated with the tool receives power from the power source). Also, in such an active state, the circuit is complete and the route of electrical current flow between the power supply and the electrical load is allowed (e.g., one or more electrical or electronic components receive electrical power from the power source).

In some embodiments, two or more tools (e.g., a transmitting tool and a receiving tool) may be configured to communicate via a suitable signal. For example, in some embodiments, two or more tools may be configured to communicate via a triggering signal, as will be disclosed herein. In some embodiments, the triggering signal may be generally defined as a signal sufficient to be sensed by a receiver portion of a tool and thereby invoke a response within the tool, as will be disclosed herein. Particularly, in some embodiments, the triggering signal may be effective to induce an electrical response within a receiving tool, upon the receipt thereof, and to transition the receiving tool from a configuration in which no electrical or electronic component associated with the receiving tool receives power from a power source associated with the receiving tool to a configuration in which one or more electrical or electronic components receive electrical power from the power source. For example the triggering signal may be formed of an electromagnetic (EM) signal, an energy signal, or any other suitable signal type which may be received or sensed by a receiving tool and induce an electrical response as would be appreciated by one of ordinary skill in the art upon viewing this disclosure.

As used herein, the term "EM signal" refers to wireless signal having one or more electrical and/or magnetic characteristics or properties, for example, with respect to time. Additionally, the EM signal may be communicated via a transmitting and/or a receiving antenna (e.g., an electrical conducting material, such as, a copper wire). For example, the EM signal may be receivable and transformable into an electrical signal (e.g., an electrical current) via a receiving antenna (e.g., an electrical conducting material, for example, a copper wire). Further, the EM signal may be transmitted at a suitable magnitude of power transmission as would be appreciated by one of ordinary skill in the art upon viewing this disclosure. In some embodiments, the triggering signal is an EM signal and is characterized as having any suitable type and/or configuration of waveform or combinations of waveforms, having any suitable characteristics or combinations of characteristics. For example, the triggering signal may be transmitted at a predetermined frequency, for example, at a frequency within the radio frequency (RF) spectrum. In some embodiments, the triggering signal comprises a frequency between approximately 3 hertz (Hz) to 300 gigahertz (GHz), for example, a frequency of approximately 10 kilohertz (kHz).

In some embodiments, the triggering signal may be an energy signal. For example, in some embodiments, the triggering signal may comprise a signal from an energy source, for example, an acoustic signal, an optical signal, a magnetic signal, an electrical signal or any other energy signal as would be appreciated by one of ordinary skill in the art upon viewing this disclosure. Further, the triggering signal may be an electrical signal communicated via one or more electrical contacts.

In some embodiments, and not intending to be bound by theory, the triggering signal is received or sensed by a receiver system and is sufficient to cause an electrical response within the receiver system, for example, the triggering signal induces an electrical current to be generated via an inductive coupling between a transmitter system and the receiver system. In some embodiments, the induced electrical response may be effective to activate one or more electronic switches of the receiver system to allow one or more routes of electrical current flow within the receiver system to supply power to an electrical load, as will be disclosed herein.

In some embodiments, a given tool (e.g., a receiving tool and/or a transmitting tool) may comprise one or more electronic circuits comprising a plurality of functional units. In some embodiments, a functional unit (e.g., an integrated circuit (IC)) may perform a single function, for example, serving as an amplifier or a buffer. The functional unit may perform multiple functions on a single chip. The functional unit may comprise a group of components (e.g., transistors, resistors, capacitors, diodes, and/or inductors) on an IC which may perform a defined function. The functional unit may comprise a specific set of inputs, a specific set of outputs, and an interface (e.g., an electrical interface, a logical interface, and/or other interfaces) with other functional units of the IC and/or with external components. In some embodiments, the functional unit may comprise repeated instances of a single function (e.g., multiple flip-flops or adders on a single chip) or may comprise two or more different types of functional units which may together provide the functional unit with its overall functionality. For example, a microprocessor or a microcontroller may comprise functional units such as an arithmetic logic unit (ALU), one or more floating-point units (FPU), one or more load or store units, one or more branch prediction units, one or more memory controllers, and other such modules. In some embodiments, the functional unit may be further subdivided into component functional units. A microprocessor or a microcontroller as a whole may be viewed as a functional unit of an IC, for example, if the microprocessor shares circuit with at least one other functional unit (e.g., a cache memory unit).

The functional units may comprise, for example, a general purpose processor, a mathematical processor, a state machine, a digital signal processor, a video processor, an audio processor, a logic unit, a logic element, a multiplexer, a demultiplexer, a switching unit, a switching element an input/output (I/O) element, a peripheral controller, a bus, a bus controller, a register, a combinatorial logic element, a storage unit, a programmable logic device, a memory unit, a neural network, a sensing circuit, a control circuit, a digital to analog converter (DAC), an analog to digital converter (ADC), an oscillator, a memory, a filter, an amplifier, a mixer, a modulator, a demodulator, and/or any other suitable devices as would be appreciated by one of ordinary skill in the art.

In FIGS. 2-3 and 8-9, a given tool (e.g., a receiving tool and/or a transmitting tool) may comprise a plurality of distributed components and/or functional units and each functional unit may communicate with one or more other functional units via a suitable signal conduit, for example, via one or more electrical connections, as will be disclosed herein. In some embodiments, a given tool comprises a plurality of interconnected functional units, for example, for transmitting and/or receiving one or more triggering signals and/or responding to one or more triggering signals.

In some embodiments where the tool comprises a receiving tool, the receiving tool may comprise a receiver system 200 configured to receive a triggering signal. In some embodiments, the receiver system 200 may be configured to transition a switching system from an inactive state to an active state to supply power to an electrical load, in response to the triggering signal. For example, in the inactive state the tool may be configured to substantially consume no power, for example, less power consumption than a conventional "sleep" or idle state. The inactive state may also be characterized as being an incomplete circuit and thereby disallows a route of electrical current flow between a power supply and an electrical load, as will be disclosed herein. In the active state the tool may be configured to provide and/or consume power, for example, to perform one or more wellbore servicing operations, as will be disclosed herein. The active state may also be characterized as being a complete circuit and thereby allows a route of electrical current flow between a power supply and an electrical load, as will be disclosed herein.

FIG. 2 is a block diagram view of an electronic circuit comprising a switching system. The receiver system 200 may generally comprise various functional units including, but not limited to a receiving unit 206, a power supply 204, a switching system 202, and an electrical load 208. For example, in the embodiment of FIG. 2, the switching system 202 may be in electrical signal communication with the receiving unit 206 (e.g., via electrical connection 254), with the power supply 204 (e.g., via electrical connection 250), and with the electrical load 208 (e.g., via electrical connection 252).

In some embodiments, the tool may comprise various combinations of such functional units (e.g., a switching system, a power supply, an antenna, and an electrical load, etc.). While FIG. 2 illustrates a particular embodiment of a receiver system comprising a particular configuration of functional units, upon viewing this disclosure one of ordinary skill in the art will appreciate that a receiver system as will be disclosed herein may be similarly employed with alternative configurations of functional units.

In some embodiments, the receiving unit 206 may be generally configured to passively receive and/or passively sense a triggering signal. As such, the receiving unit 206 is a passive device and is not electrically coupled to a power source or power supply. For example, the receiving unit 206 does not require electrical power to operate and/or to generate an electrical response. Additionally, the receiving unit 206 may be configured to convert an energy signal (e.g., a triggering signal) to a suitable output signal, for example, an electrical signal sufficient to activate the switching system 202.

In some embodiments, the receiving unit 206 may comprise the one or more antennas. The antennas may be configured to receive a triggering signal, for example, an EM signal. For example, the antennas may be configured to be responsive to a triggering signal comprising a frequency within the RF spectrum (e.g., from approximately 3 Hz to 300 GHz). In some embodiments, the antennas may be responsive to a triggering signal within the 10 kHz band. In other embodiments, the antennas may be configured to be responsive to any other suitable frequency band as would be appreciated by one of ordinary skill in the art upon viewing this disclosure. The antennas may generally comprise a monopole antenna, a dipole antenna, a folded dipole antenna, a patch antenna, a microstrip antenna, a loop antenna, an omnidirectional antenna, a directional antenna, a planar inverted-F antenna (PIFA), a folded inverted conformal antenna (FICA), any other suitable type and/or configuration of antenna as would be appreciated by one of ordinary skill in the art upon viewing this disclosure, or combinations thereof. For example, the antenna may be a loop antenna and, in response to receiving a triggering signal of approximately a predetermined frequency, the antenna may inductively couple and/or generate a magnetic field which may be converted into an electrical current or an electrical voltage (e.g., via inductive coupling). Additionally, the antennas may comprise a terminal interface and/or may be configured to physically and/or electrically connect to one or more functional units, for example, the switching system 202 (as shown in FIG. 2). For example, the terminal interface may comprise one or more wire leads, one or more metal traces, a BNC connector, a terminal connector, an optical connector, and/or any other suitable connection interfaces as would be appreciated by one of ordinary skill in the art upon viewing this disclosure.

In some embodiments, the receiving unit 206 may comprise one or more passive transducers. For example, a passive transducer may be in electrical signal communication with the switching system 202 and may be employed to experience a triggering signal (e.g., an acoustic signal, an optical signal, a magnetic signal, etc.) and to output a suitable signal (e.g., an electrical signal sufficient to activate the switching system 202) in response to sensing and/or detecting the triggering signal. For example, suitable transducers may include, but are not limited to, acoustic sensors, accelerometers, capacitive sensors, piezoresistive strain gauge sensors, ferroelectric sensors, electromagnetic sensors, piezoelectric sensors, optical sensors, a magneto-resistive sensor, a giant magneto-resistive (GMR) sensor, a microelectromechanical systems (MEMS) sensor, a Hall-effect sensor, a conductive coils sensor, or any other suitable type of transducers as would be appreciated by one of ordinary skill in the art upon viewing this disclosure.

Additionally, in some embodiments, the antennas or sensors may be electrically coupled to a signal conditioning filter (e.g., a low-pass filter, a high-pass filter, a band-pass filter, and/or a band-stop filter). In some embodiments, the signal conditioning filter may be employed to remove and/or substantially reduce frequencies outside of a desired frequency range and/or bandwidth. For example, the signal conditioning filter may be configured to reduce false positives caused by signals having frequencies outside of the desired frequency range and/or bandwidth. Further, the antennas may include an electromagnetic resonance based on electrically coupling a capacitor to the antenna, for example. The electromagnetic resonance may be utilized to tune the antenna to be sensitive to the resonant frequency, and thereby, increase the energy coupling efficiency at the resonant frequency.

In some embodiments, the power supply (e.g., the power supply 204) may supply power to the switching system 202 and/or any other functional units of the tool. Additionally, the power supply 204 may supply power to the load when enabled by the switching system 202. The power supply may comprise an on-board battery, a renewable power source, a voltage source, a current source, or any other suitable power source as would be appreciated by one of ordinary skill in the art upon viewing this disclosure. For example, the power source may be a Galvanic cell or a lithium battery. Additionally, in some embodiments, the power supply may be configured to supply any suitable voltage, current, and/or power required to power and/operate the electrical load 208. For example, in some embodiments, the power supply may supply power in the range of approximately 0.003 watts to 10 watts. Additionally, the power supply may supply voltage in the range of approximately 1.0 volts (V) to 48 V.

Figure 3:
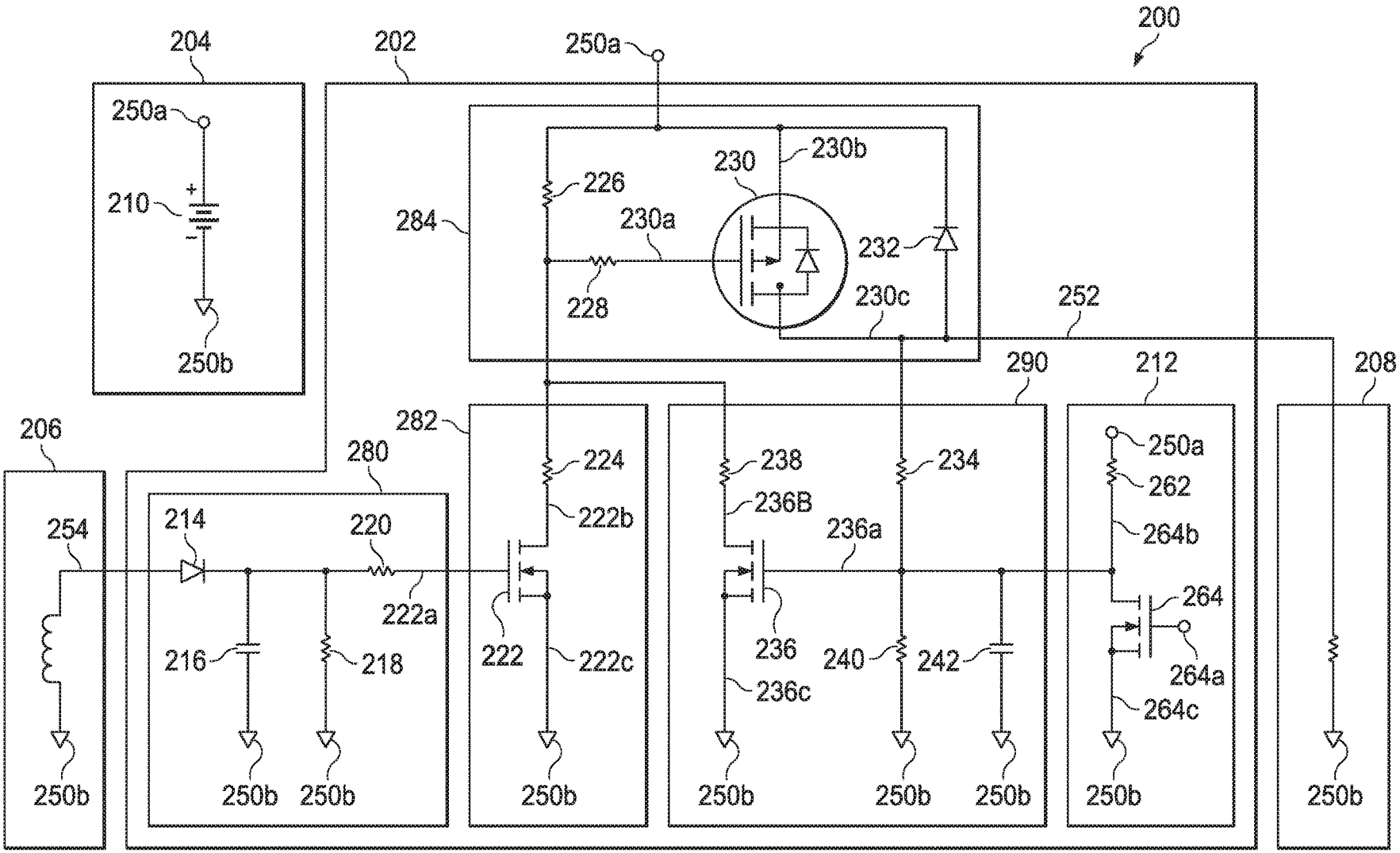
FIG. 3 is a schematic view of an electronic circuit comprising a switching system.

FIG. 3 is a schematic view of an electronic circuit comprising a switching system. In some embodiments, the switching system 202 is configured to selectively transition from a first state where the switching system 202 is an incomplete circuit and a route of electrical current between the power supply 204 and the electrical load 208 is disallowed (e.g., an inactive state) to a second state where the switching system 202 is a complete circuit and a route of electrical current between the power supply 204 and the electrical load 208 is allowed to provide electrical power from the power supply 204 to the electrical load 208 (e.g., an active state) upon receiving and/or experiencing a triggering signal, as will be disclosed herein. Additionally, in the inactive state the tool is configured to not consume power. For example, in the embodiment of FIG. 3, the switching system 202 comprises a plurality of components coupled to the power supply 204 and is configured to provide power to the electrical load when so-configured. For example, in some embodiments, the power supply 204 may comprise a battery 210 having a positive voltage terminal 250*a* and the electrical ground 250*b*.

In some embodiments, the switching system 202 comprises a rectifier portion 280, a triggering portion 282, and a power switching portion 284. For example, the rectifier portion 280 may be configured to convert a triggering signal (e.g., an alternating current (AC) signal) received by the receiving unit 206 to a rectified signal (e.g., a direct current (DC) signal) to be applied to the triggering portion 282. In some embodiments, the rectifier portion 280 may comprise a diode 214 electrically coupled (e.g., via an anode terminal) to the receiving unit 206 and electrically coupled (e.g., via a cathode terminal) to a capacitor 216 and a resistor 218 connected in parallel with the electrical ground 250*b* and a resistor 220 electrically coupled to the triggering portion 282 (e.g., via an input terminal).

In some embodiments, the triggering portion 282 may comprise an electronic switch 222 (e.g., a transistor, a mechanical relay, a silicon-controlled rectifier, etc.) configured to selectively allow a route of electrical current communication between a first terminal (e.g., a first switch terminal 222*b*) and a second terminal (e.g., a second switch terminal 222*c*) upon experiencing a voltage or current applied to an input terminal (e.g., an input terminal 222*a*), for example, to activate the power switching portion 284, as will be disclosed herein. For example, in the embodiment of FIG. 3, the electronic switch 222 is a transistor (e.g., a n-channel metal-oxide-semiconductor field effect transistor (NMOSFET)). The electronic switch 222 may be configured to selectively provide an electrical current path between the positive voltage terminal 250*a* and the electrical ground 250*b*, for example, via resistors 226 and 224, the first terminal 222*b*, and the second terminal 222*c* upon experiencing a voltage (e.g., a voltage greater than the threshold voltage of the NMOSFET) applied to the input terminal 222*a*, for example, via the rectifier portion 280. Additionally, in the embodiment of FIG. 3, the triggering portion 282 may be configured to activate the power switching portion 284 (e.g., thereby providing a route of electrical current flow from the power supply 204 to the electrical load 208) until the voltage applied to the input terminal 222*a* falls below a threshold voltage required to activate the electronic switch 222.

In some embodiments, the power switching portion 284 may comprise a second electronic switch 230 (e.g., a transistor, a mechanical relay, etc.) configured to provide power from the power supply 204 (e.g., the positive voltage terminal 250*a*) to the electrical load 208 (e.g., a packer, a sensor, an actuator, etc.). For example, in the embodiment of FIG. 3, the second electronic switch 230 is a transistor (e.g., a p-channel metal-oxide-semiconductor field effect transistor (PMOSFET)). The second electronic switch 230 may be configured to provide an electrical current path between the power supply 204 and the electrical load 208 (e.g., via a first terminal 230*b* and a second terminal 230*c*) upon experiencing a voltage drop at an input terminal 230*a*, for example, a voltage drop caused by the activation of the triggering portion 282 and/or a feedback portion 290, as will be disclosed herein. In some embodiments, the input terminal 230*a* may be electrically coupled to the triggering portion 282 via a resistor 228, for example, at an electrical node or junction between the resistor 224 and the resistor 226. In some embodiments, the first terminal 230*b* is electrically coupled to the positive voltage terminal 250*a* of the power supply 204 and the second terminal 230*c* is electrically coupled to the electrical load 208. Further, a diode 232 may be electrically coupled across the first terminal 230*b* and the second terminal 230*c* of the electronic switch 230 and may be configured to be forward biased in the direction from the second terminal 230*c* to the first terminal 230*b*.

Additionally, the switching system 202 may further comprise a feedback portion 290. In some embodiments, the feedback portion 290 may be configured to keep the power switching portion 284 active (e.g., providing power from the power supply 204 to the electrical load 208), for example, following the deactivation of the triggering portion. For example, in the embodiment of FIG. 3, the feedback portion comprises a third electronic switch 236 (e.g., a NMOSFET transistor). In some embodiments, an input terminal 236*a* of the third electronic switch 236 is electrically coupled to power switching portion (e.g., the second terminal 230*c* of the second electronic switch 230 via the resistor 234). Additionally, the third electronic switch 236 may be configured to provide an electrical current path between the positive voltage terminal 250*a* and the electrical ground 250*b*, for example, via the resistor 226, a resistor 238, a first terminal 236*b*, and a second terminal 236*c* upon experiencing a voltage (e.g., a voltage greater than the threshold voltage of the NMOSFET) applied to the input terminal 236*a*, for example, via the power switching portion 284. Further, the third electronic switch 236 may be electrically coupled to the power switching portion 284, for example, the input terminal 230*a* of the second electronic switch 230 via the resistor 228, the resistor 238, and the first terminal 236*b*. Additionally in the embodiment of FIG. 3, the feedback portion 290 comprises a resistor-capacitor (RC) circuit, for example, an RC circuit comprising a resistor 240 and a capacitor 242 in parallel and electrically coupled to the input terminal 236*a* of the third electronic switch 236 and the electrical ground 250*b*. In some embodiments, the RC circuit is configured such that an electrical current charges one or more capacitors (e.g., the capacitor 242) and, thereby generates and/or applies a voltage signal to the input terminal 236*a* of the third electronic switch 236. In some embodiments, the one or more capacitors may charge (e.g., accumulate voltage) and/or decay (e.g., exit and/or leak voltage) over time at a rate proportional to an RC time constant established by the resistance and the capacitance of the one or more resistors and the one or more capacitors of the RC circuit. For example, in some embodiments, the RC circuit may be configured such that the charge and/or voltage of the one or more capacitors of the RC circuit accumulates over a suitable duration of time to allow power transmission from the power supply 204 to the electrical load 208, as will be disclosed herein. For example, suitable durations of time may be approximately 10 milliseconds (ms) to 120 minutes, and/or any other suitable duration of time, as would be appreciated by one of ordinary skill in the art upon viewing this disclosure.

Additionally, the switching system 202 may further comprise a power disconnection portion 212. In some embodiments, the power disconnection portion 212 may be configured to deactivate the feedback portion 290 and thereby suspend the power transmission between the power supply 204 and the electrical load 208. Additionally, the power disconnection portion 212 comprises a fourth electronic switch 264 (e.g., a NMOSFET transistor). In some embodiments, an input terminal 264*a* of the fourth electronic switch 264 is electrically coupled to an external voltage trigger (e.g., an input-output (I/O) port of a processor or controller). Additionally, the fourth electronic switch 264 may be configured to provide an electrical current path between the positive voltage terminal 250*a* and the electrical ground 250*b*, for example, via a resistor 262, a first terminal 264*b*, and a second terminal 264*c* upon experiencing a voltage (e.g., a voltage greater than the threshold voltage of the NMOSFET) applied to the input terminal 264*a*, for example, via an I/O port of a processor or controller. Further, the fourth electronic switch 264 may be electrically coupled to the feedback portion 290. For example, the input terminal 236*a* of the third electronic switch 236 may be electrically coupled to the power disconnection portion 212 via the first terminal 264*b* of the fourth electronic switch 264. In some embodiments, the input terminal 264*a* of the fourth electronic switch 264 is electrically coupled to the rectifier portion 280 and configured such that a rectified signal generated by the rectifier portion 280 (e.g., in response to a triggering signal) may be applied to the fourth electronic switch 264 to activate the fourth electronic switch 264. In some embodiments, the input terminal 264*a* of the fourth electronic switch 264 is electrically coupled to the rectifier portion 280 via a latching system. For example, the latching system may be configured to toggle in response to the rectified signal generated by the rectifier portion 280. In some embodiments, the latching system may be configured to not activate the power disconnection portion 212 in response to a first rectified signal (e.g., in response to a first triggering signal) and to activate the power disconnection portion 212 in response to a second rectified signal (e.g., in response to a second triggering signal). As such, the power disconnection portion 212 will deactivate the feedback portion 290 in response to the second rectified signal. Any suitable latching system may be employed as would be appreciate by one of ordinary skill in the art upon viewing this disclosure.

Figure 4:
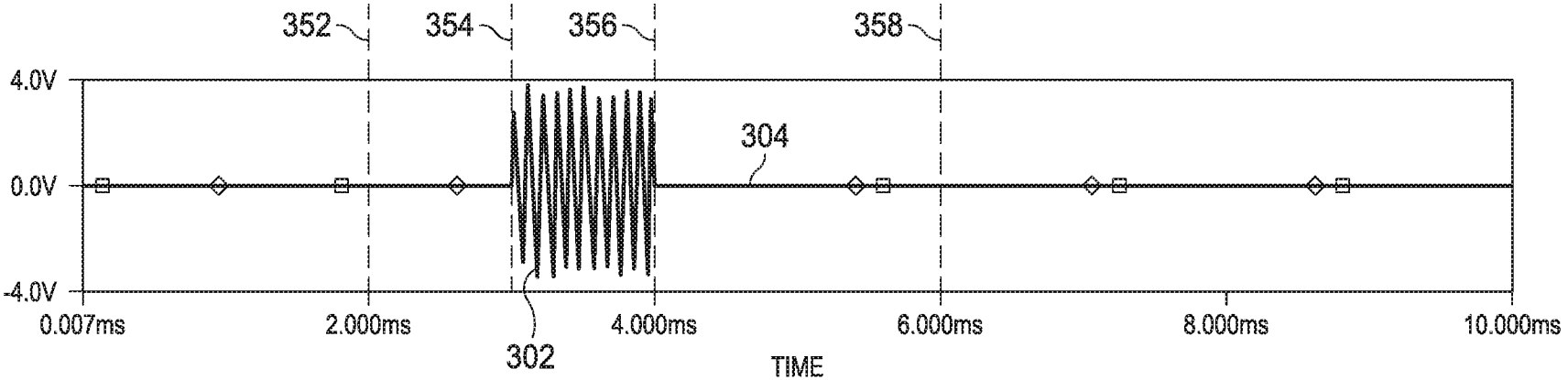
FIG. 4 is an exemplary plot of a diode voltage and a rectified diode voltage with respect to time measured at the input of a switching system.
Figure 5:
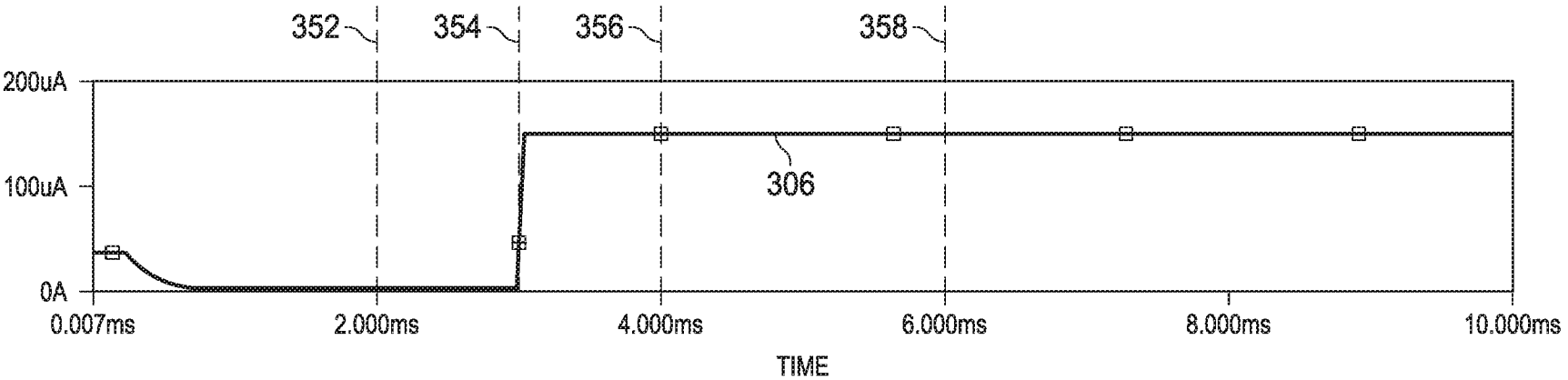
FIG. 5 is an exemplary plot of current flow measured over time through an electronic switch of a switching system.
Figure 6:
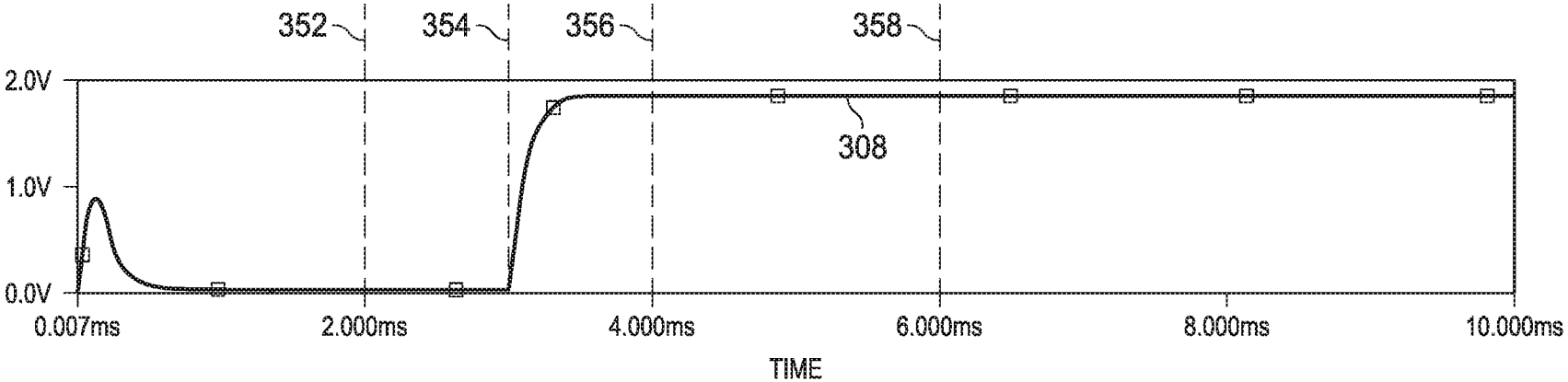
FIG. 6 is an exemplary plot of an electronic switch input voltage with respect to time of a switching system.
Figure 7:
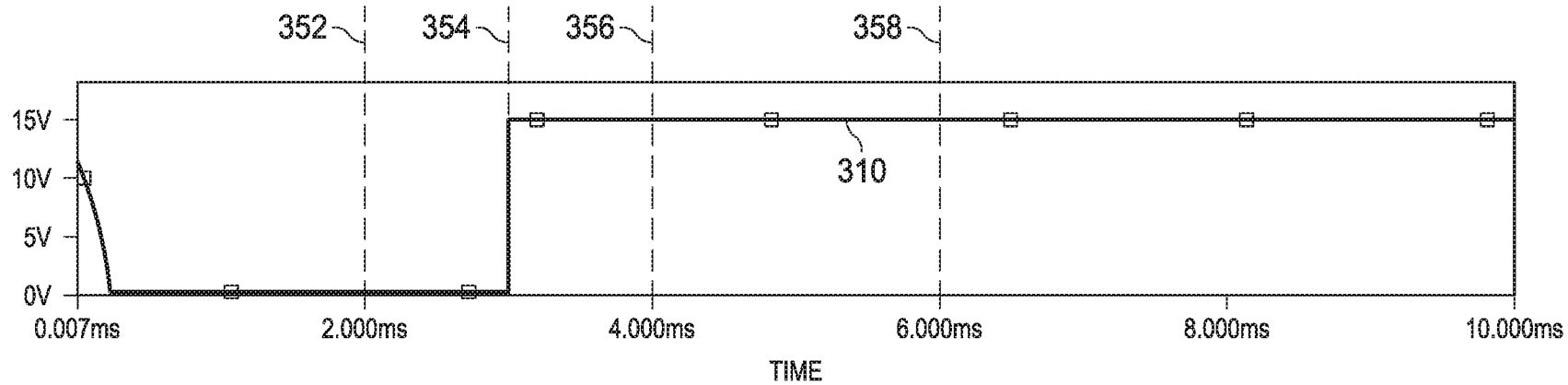
FIG. 7 is an exemplary plot of a load voltage measured with respect to time of an electrical load.

In the embodiment of FIG. 3, the receiver system 200 is configured to remain in the inactive state such that the switching system 202 is an incomplete circuit until sensing and/or receiving a triggering signal to induce an electrical response and thereby completing the circuit. For example, the one or more components of the switching system 202 are configured to remain in a steady state and may be configured to draw substantially no power, as shown at time 352 in FIGS. 4-7. FIG. 4 is an exemplary plot of a diode voltage and a rectified diode voltage with respect to time measured at the input of a switching system. Further, FIG. 5 is an exemplary plot of current flow measured over time through an electronic switch of a switching, and FIG. 6 is an exemplary plot of an electronic switch input voltage with respect to time of a switching system. Additionally, FIG. 7 is an exemplary plot of a load voltage measured with respect to time of an electrical load.

In some embodiments, the receiving system 200 is configured such that in response to the receiving unit 206 experiencing a triggering signal (e.g., a triggering signal 304 as shown between time 354 and time 356 in FIG. 4) an electrical response is induced causing the rectifier portion of the switching system 202 will generate and/or store a rectified signal (e.g., a rectified signal 302 as shown between time 354 and time 356 in FIG. 4). The rectified signal may be applied to the electronic switch 222 and may be sufficient to activate the electronic switch 222 and thereby provide a route of electrical current communication across the electronic switch 222, for example, between the first terminal 222*b* and the second terminal 222*c* of the electronic switch 222. In some embodiments, activating the electronic switch 222 may configure the switching system 202 to allow a current to flow (e.g., a current 306 as shown from time 354 onward in FIG. 5) between the positive voltage terminal 250*a* and the electrical ground 250*b* via the resistor 226, the resistor 224, and the electronic switch 222. As such, the switching system 202 is configured such that inducing a current (e.g., via the electronic switch 222), activates the second electronic switch 230, for example, in response to a voltage drop caused by the induced current and experienced by the input terminal 230*a*. In some embodiments, activating the second electronic switch 230 configures the switching system 202 to form a complete circuit and to allow a current to flow from the positive voltage terminal 250*a* to the electrical load 208 via the second electronic switch 230 and, thereby provides power to the electrical load 208. In the embodiment of FIG. 3, the electrical load 208 is a resistive load and is configured such that providing a current to the electrical load 208 induces a voltage across the electrical load 208 (e.g., as shown as a voltage signal 310 in FIG. 7). Further, the electrical load 208 may be any other suitable type electrical load as would be appreciated by one of ordinary skill in the art upon viewing this disclosure, as will be disclosed herein.

Additionally, where the switching system 202 comprises a feedback portion 290, activating the second electronic switch 230 configures the switching system 202 to allow a current flow to the RC circuit of the feedback portion 290 which may induce a voltage (e.g., a voltage 308 as shown in FIG. 6) sufficient to activate the third electronic switch 236 and thereby provide a route of electrical current communication across the third electronic switch 236, for example, between the first terminal 236*b* and the second terminal 236*c* of the third electronic switch 236. In some embodiments, activating the third electronic switch 236 configures the switching system 202 to generate a current flow between the positive voltage terminal 250*a* and the electrical ground 250*b* via the resistor 226, the resistor 238, and the third electronic switch 236. As such, the switching system 202 is configured such that inducing a current (e.g., via the third electronic switch 236), retains the second electronic switch 230 in the activated state, for example, as shown from time 358 onward in FIGS. 4-7.

In an additional embodiment, where the switching system 202 comprises a power disconnection portion 212, applying a voltage (e.g., via an I/O port of a processor or controller) to the input terminal 264*a* of the fourth electrical switch 264 configures the switching system 202 to deactivate the feedback portion 290 and thereby suspend the power transmission between the power supply 204 and the electrical load 208. For example, activating the fourth electronic switch 264 causes an electrical current path between the input terminal 236*a* of the third electronic switch 236 and the electrical ground 250*b* via the first terminal 264*b* and the second terminal 264*c* of the fourth electronic switch 264. As such, the voltage applied to input terminal 236*a* of the third electronic switch 236 may fall below voltage level sufficient to activate the third electronic switch 236 (e.g., below the threshold voltage of the NMOSFET) and thereby deactivates the third electronic switch 236 and the feedback portion 290.

In some embodiments, the electrical load (e.g., the electrical load 208) may be a resistive load, a capacitive load, and/or an inductive load. For example, the electrical load 208 may comprise one or more electronically activatable tool or devices. As such, the electrical load may be configured to receive power from the power supply (e.g., power supply 204) via the switching system 202, when so-configured. In some embodiments, the electrical load 208 may comprise a transducer, a microprocessor, an electronic circuit, an actuator, a wireless telemetry system, a fluid sampler, a detonator, a motor, a transmitter system, a receiver system, a transceiver, a sensor, a telemetry device, or any other suitable passive or active electronically activatable tool or devices, or combinations thereof.

Figure 8:
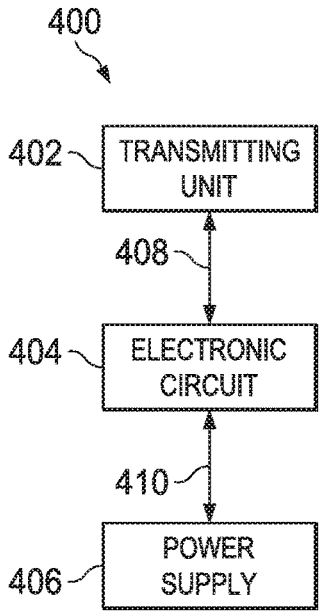
FIG. 8 is a block diagram view of a transmitter system.

In an additional embodiment, the transmitting tool may further comprise a transmitter system 400 configured to transmit a triggering signal to one or more other tools. FIG. 8 is a block diagram view of a transmitter system. The transmitter system 400 may generally comprise various functional units including, but not limited to a power supply 406, a transmitting unit 402, and an electronic circuit 404. For example, the electronic circuit 404 may be in electrical signal communication with the transmitting unit 402 (e.g., via electrical connection 408) and with the power supply 406 (e.g., via electrical connection 410).

In some embodiments, the tool may comprise various combinations of such functional units (e.g., a power supply, an antenna, and an electronic circuit, etc.). While FIG. 8 illustrates a particular embodiment of a transmission system comprising a particular configuration of functional units, upon viewing this disclosure one of ordinary skill in the art will appreciate that a transmission system as will be disclosed herein may be similarly employed with alternative configurations of functional units.

In some embodiments, the transmitting unit 402 may be generally configured to transmit a triggering signal. For example, the transmitting unit 402 may be configured to receive an electronic signal and to output a suitable triggering signal (e.g., an electrical signal sufficient to activate the switching system 202).

In some embodiments, the transmitting unit 402 may comprise one or more antennas. The antennas may be configured to transmit and/or receive a triggering signal, similarly to what has been previously disclosed with respect to the receiving unit 206. In some embodiments, the transmitting unit 402 may comprise one or more energy sources (e.g., an electromagnet, a light source, etc.). As such, the energy source may be in electrical signal communication with the electronic circuit 404 and may be employed to generate and/or transmit a triggering signal (e.g., an acoustic signal, an optical signal, a magnetic signal, etc.).

In some embodiments, the power supply (e.g., the power supply 406) may supply power to the electronic circuit 404, and/or any other functional units of the transmitting tool, similarly to what has been previously disclosed.

Figure 9:
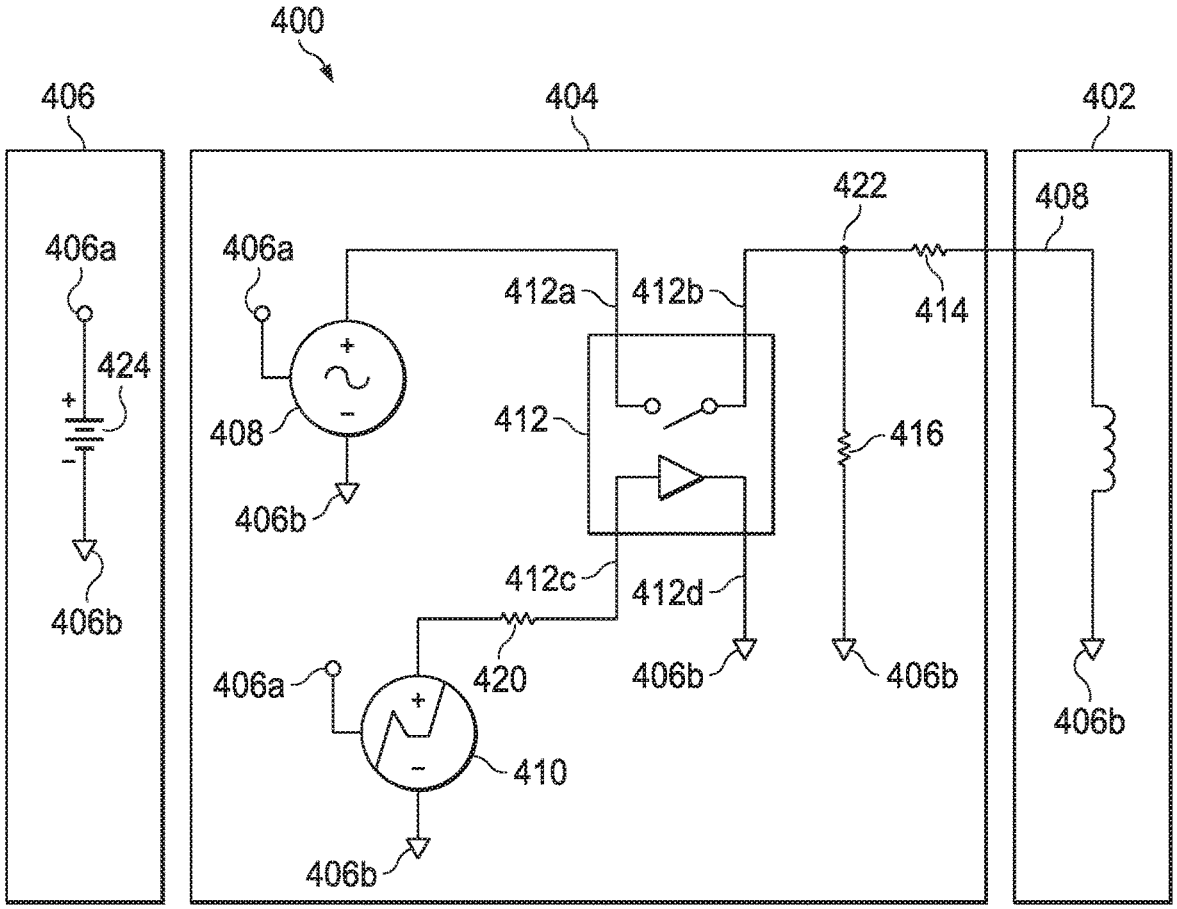
FIG. 9 is a schematic view of a transmitter system.

FIG. 9 is a schematic view of a transmitter system. In some embodiments, the electronic circuit 404 is configured to generate and transmit a triggering signal. For example, the electronic circuit 404 may comprise a pulsing oscillator circuit configured to periodically generate a triggering signal. In some embodiments, the electronic circuit 404 comprises an electronic switch 412 (e.g., a mechanical relay, a transistor, etc.). In some embodiments, the electronic switch 412 may be configured to provide a route of electrical signal communication between a first contact 412*a* (e.g., a normally open input) and a second contact 412*b* (e.g., a common input) in response to the application of an electrical voltage or current across a third contact 412*c* and a fourth contact 412*d*. For example, the third contact 412*c* and the fourth contact 412*d* may be terminal contacts of an electronic gate, a relay coil, a diode, etc. In some embodiments, the electronic circuit 404 comprises an oscillator 408 in electrical signal communication with the first contact 412*a* of the electronic switch 412. In some embodiments, the oscillator 408 may be configured to generate a sinusoidal signal, for example, a sinusoidal waveform having a frequency of approximately 10 kHz. Additionally, the electronic circuit 404 comprises a pulse generator 410 in electrical signal communication with the third contact 412*c* of the electronic switch 412 via a resistor 420. In some embodiments, the pulse generator 410 may be configured to periodically generate a pulse signal (e.g., a logical voltage high) for a predetermined duration of time, for example, an approximately 100 Hz signal with a pulse having a pulse width of approximately 1 millisecond (ms). Further, the electronic switch 412 is electrically connected to an electrical ground 406*b* via the fourth contact 412*d*. Additionally, the electronic switch 412 is in electrical signal communication with a resistor network, for example, via the second contact 412*b* electrically connected to an electrical node 422. For example, the resistor network may comprise a resistor 416 coupled between the electrical node 422 and the electrical ground 406*b* and a resistor 414 coupled between the electrical node 422 and the transmitting unit 402. Further, one or more components of the electronic circuit 404 (e.g., the oscillator 408, the pulse generator 410, etc.) are electrically coupled to the power supply 406. For example, in some embodiments, the power supply 406 may comprise a battery 424 having a positive voltage terminal 406*a* and the electrical ground 406*b* and may provide power to the oscillator 408 and/or the pulse generator 410.

In some embodiments, the transmitter system 400 is configured such that applying a pulse signal to the third contact 412*c* of the electronic switch 412 induces a voltage and/or current between the third contact 412*c* and the fourth contact 412*d* of the electronic switch 412 and, thereby activates the electronic switch 412 to provide a route of electrical signal communication between the first contact 412*a* and the second contact 412*b*. As such, a triggering signal (e.g., a sinusoidal signal) is communicated from the oscillator 408 to the transmitting unit 402 via the electronic switch 412 and the resistor network upon the application of a pulse signal from the pulse generator 410 across the electronic switch 412. As such, the transmitting unit 402 is configured to transmit the triggering signal (e.g., the sinusoidal signal).

In some embodiments, the receiving and/or transmitting tool may further comprise a processor (e.g., electrically coupled to the switching system 202 or the electronic circuit 404), which may be referred to as a central processing unit (CPU), may be configured to control one or more functional units of the receiving and/or transmitting tool and/or to control data flow through the tool. For example, the processor may be configured to communicate one or more electrical signals (e.g., data packets, control signals, etc.) with one or more functional units of the tool (e.g., a switching system, a power supply, an antenna, an electronic circuit, and an electrical load, etc.) and/or to perform one or more processes (e.g., filtering, logical operations, signal processing, counting, etc.). For example, the processor may be configured to apply a voltage signal (e.g., via an I/O port) to the power disconnection portion 212 of the switching system 202, for example, following a predetermined duration of time. In some embodiments, one or more of the processes may be performed in software, hardware, or a combination of software and hardware. In some embodiments, the processor may be implemented as one or more CPU chips, cores (e.g., a multi-core processor), digital signal processor (DSP), an application specific integrated circuit (ASIC), and/or any other suitable type and/or configuration as would be appreciated by one of ordinary skill in the arts upon viewing this disclosure.

In some embodiments, one or more tools may comprise a receiver system 200 and/or a transmitter system 400 (e.g., disposed within an interior portion of the tool) and each having a suitable configuration, as will be disclosed herein, may be utilized or otherwise deployed within an operational environment such as previously disclosed.

In some embodiments, a tool may be characterized as stationary. For example, in some embodiments, such a stationary tool or a portion thereof may be in a relatively fixed position, for example, a fixed position with respect to a tubular string disposed within a wellbore. For example, in some embodiments a tool may be configured for incorporation within and/or attachment to a tubular string (e.g., a drill string, a work string, a coiled tubing string, a jointed tubing string, or the like). In some embodiments, a tool may comprise a collar or joint incorporated within a string of segmented pipe and/or a casing string.

Additionally, in some embodiments, the tool may comprise and/or be configured as an actuatable flow assembly (AFA). In some embodiments, the AFA may generally comprise a housing and one or more sleeves movably (e.g., slidably) positioned within the housing. For example, the one or more sleeves may be movable from a position in which the sleeves and housing cooperatively allow a route of fluid communication to a position in which the sleeves and housing cooperatively disallow a route of fluid communication, or vice versa. For example, in some embodiments, the one or more sleeves may be movable (e.g., slidable) relative to the housing so as to obstruct or unobstruct one or more flow ports extending between an axial flowbore of the AFA and an exterior thereof. In various embodiments, a node comprising an AFA may be configured for use in a stimulation operation (such as a fracturing, perforating, or hydrojetting operation, an acidizing operation), for use in a drilling operation, for use in a completion operation (such as a cementing operation or fluid loss control operation), for use during production of formation fluids, or combinations thereof. Suitable examples of such an AFA are disclosed in U.S. patent application Ser. No. 13/781,093 to Walton et al. filed on Feb. 28, 2013 and U.S. patent application Ser. No. 13/828,824 filed on Mar. 14, 2013.

In some embodiments, the tool may comprise and/or be configured as an actuatable packer. In some embodiments, the actuatable packer may generally comprise a packer mandrel and one or more packer elements that exhibit radial expansion upon being longitudinally compressed. The actuatable packer may be configured such that, upon actuation, the actuatable pack is caused to longitudinally compress the one or more packer elements, thereby causing the packer elements to radially expand into sealing contact with the wellbore walls or with an inner bore surface of a tubular string in which the actuatable packer is disposed. Suitable examples of such an actuatable packer are disclosed in U.S. patent application Ser. No. 13/660,678 to Helms et al. filed on Oct. 25, 2012.

In some embodiments, the tool may comprise and/or be configured as an actuatable valve assembly (AVA). In some embodiments, the AVA may generally comprise a housing generally defining an axial flowbore therethrough and an actuatable valve. The actuatable valve may be positioned within the housing (e.g., within the axial flowbore) and may be transitionable from a first configuration in which the actuatable valve allows fluid communication via the axial flowbore in at least one direction to a second configuration in which the actuatable valve does not allow fluid communication via the flowbore in that direction, or vice versa. Suitable configurations of such an actuatable valve include a flapper valve and a ball valve. In some embodiments, the actuatable valve may be transitioned from the first configuration to the second configuration, or vice-verse, via the movement of a sliding sleeve also positioned within the housing, for example, which may be moved or allowed to move upon the actuation of an actuator Suitable examples of such an AVA are disclosed in International Application No. PCT/US13/27674 filed Feb. 25, 2013 and International Application No. PCT/US13/27666 filed Feb. 25, 2013.

Further, a tool may be characterized as transitory. For example, in some embodiments, such a transitory tool may be mobile and/or positionable, for example, a ball or dart configured to be introduced into the wellbore, communicated (e.g., pumped/flowed) within a wellbore, removed from the wellbore, or any combination thereof. In some embodiments, a transitory tool may be a flowable or pumpable component, a disposable member, a ball, a dart, a wireline or work string member, or the like and may be configured to be communicated through at least a portion of the wellbore and/or a tubular disposed within the wellbore along with a fluid being communicated therethrough. For example, such a tool may be communicated downwardly through a wellbore (e.g., while a fluid is forward-circulated into the wellbore). Additionally, such a tool may be communicated upwardly through a wellbore (e.g., while a fluid is reverse-circulated out of the wellbore or along with formation fluids flowing out of the wellbore).

In some embodiments, where the transitory tool is a disposable member (e.g., a ball), the transitory tool may be formed of a sealed (e.g., hermetically sealed) assembly. As such, the transitory tool may be configured such that access to the interior, a receiver system 200, and/or transmitter system 400 is no longer provided and/or required. Such a configuration may allow the transitory tool to be formed having minimal interior air space and, thereby increasing the structural strength of the transitory tool. For example, such a transitory tool may be configured to provide an increase in pressure holding capability. Additionally, such a transitory tool may reduce and/or prevent leakage pathways from the exterior to an interior portion of the transitory tool and thereby reduces and/or prevents potential corruption of any electronics (e.g., the receiver system 200, the transmitter system 400, etc.).

In some embodiments, the tool may be sealed in a welded assembly, as a threaded assembly, as a chemically bonded assembly, or as a combination thereof. The tool may be sealed when it is near the well site for protection of the tool. Further, gas migration may be minimized is the tool is welded or a metal-to-metal seal is utilized. When the tool is sealed, some embodiments may allow reprogramming or communicating with the tool without the need to unseal the tool. For example, communication may be used for tool identification, firmware programming, or status updates.

In some embodiments, one or more receiving tools and transmitting tools employing a receiver system 200 and/or a transmitter system 400 and having, for example, a configuration and/or functionality as disclosed herein, or a combination of such configurations and functionalities, may be employed in a wellbore servicing system and/or a wellbore servicing method, as will be disclosed.

Figure 10:
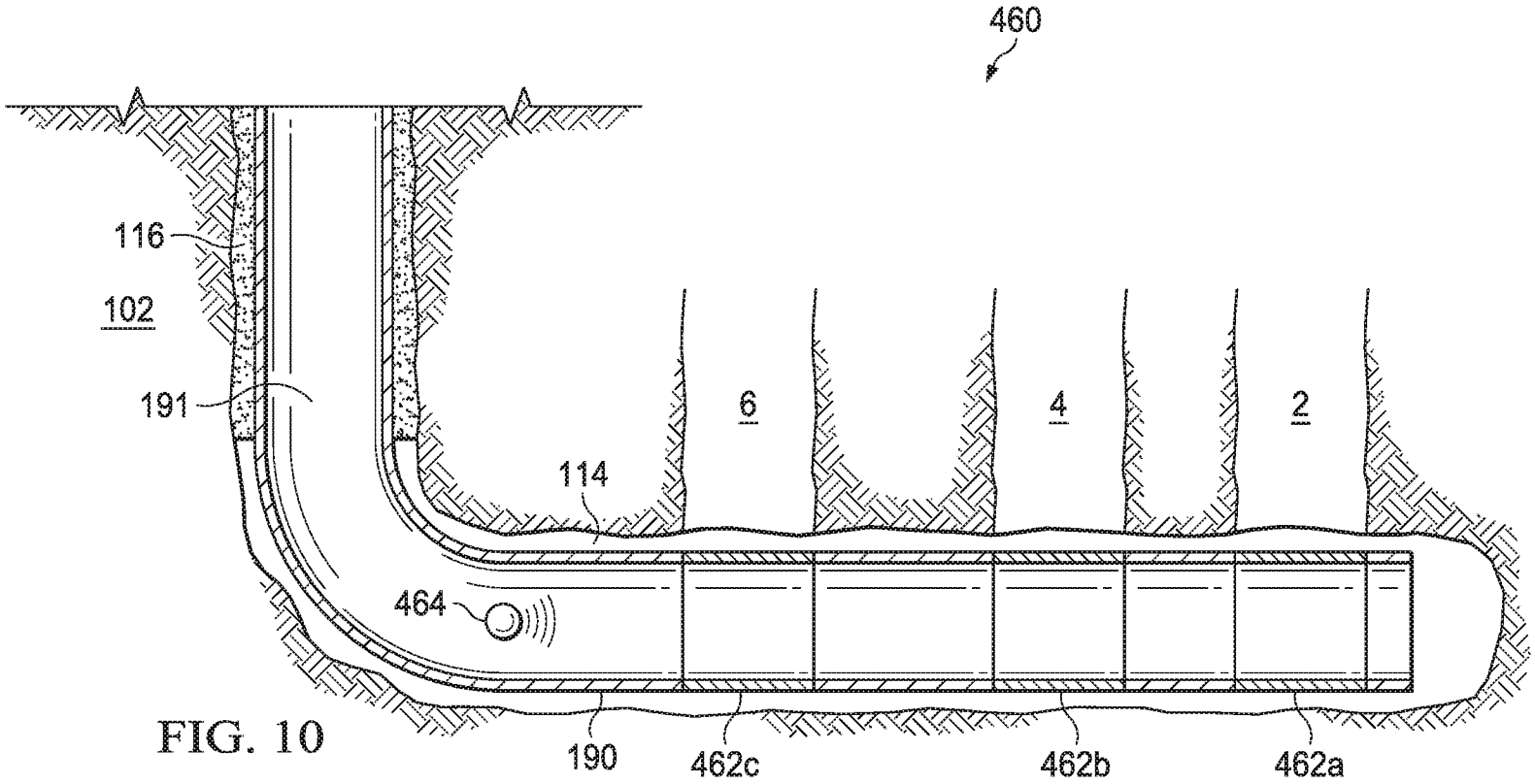
FIGS. 10 through 12 are representative partially cross-sectional views of wellbore servicing systems.
Figure 11:
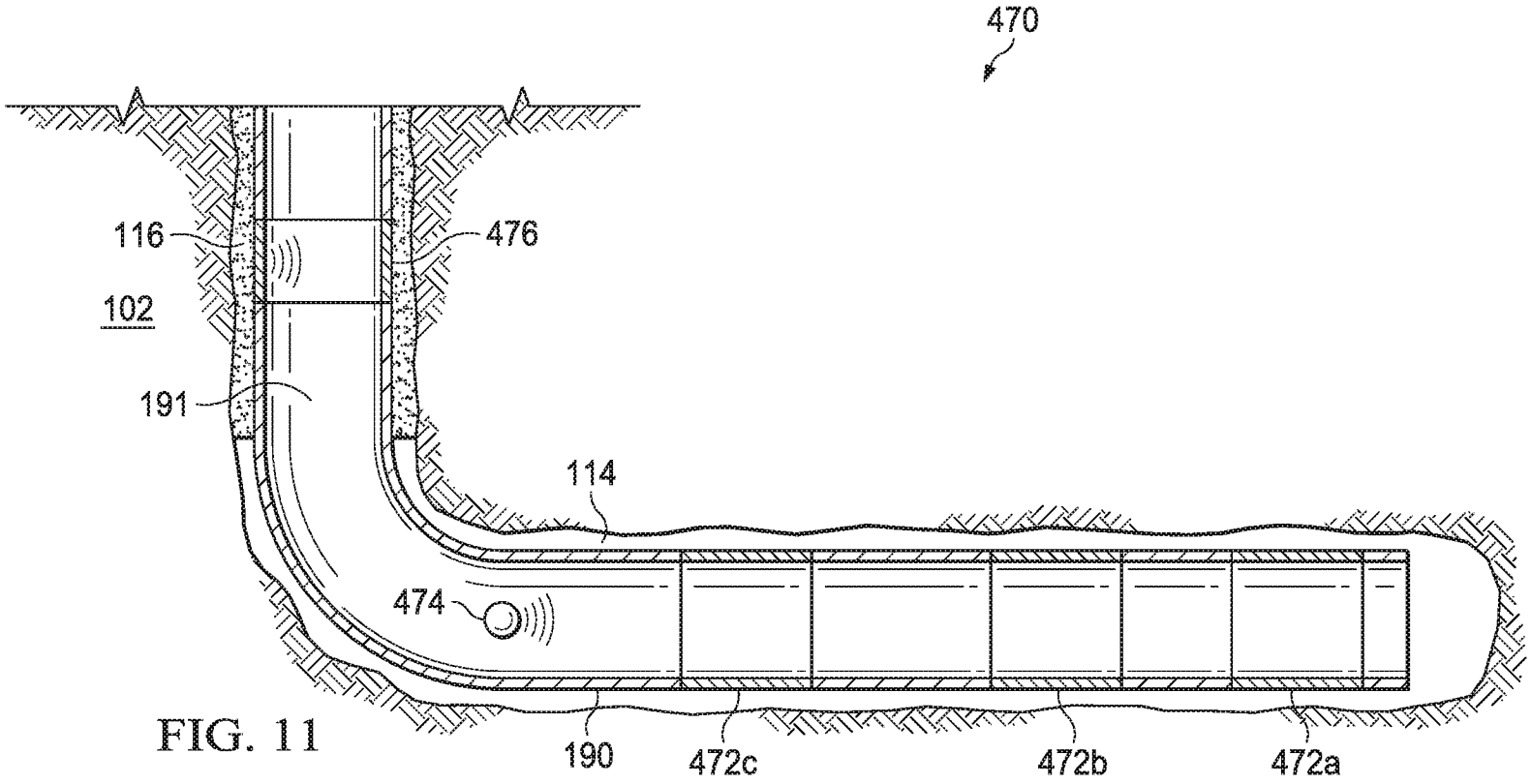
Figure 12:
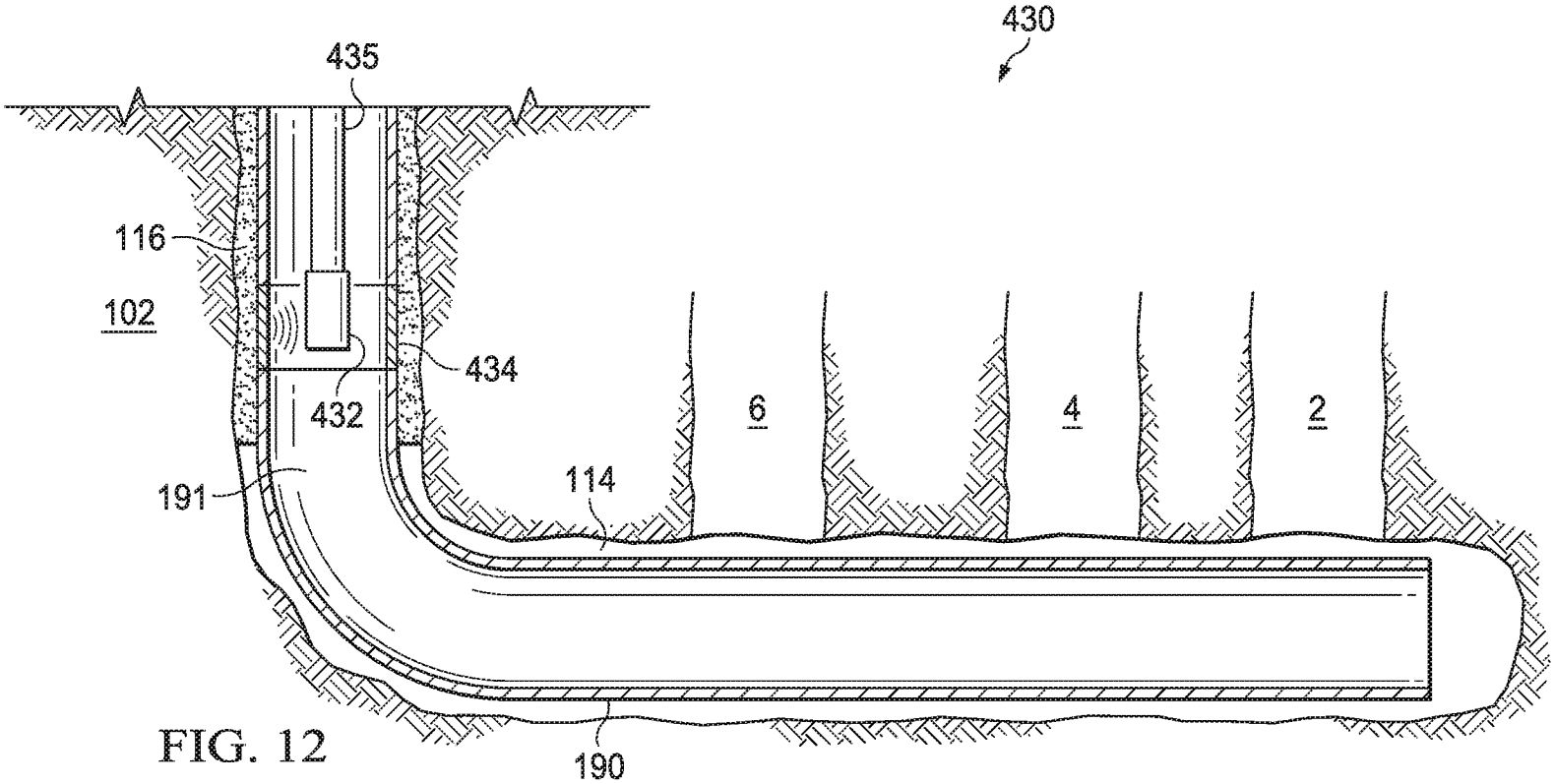

FIGS. 10 through 12 are representative partially cross-sectional views of wellbore servicing systems. Referring to FIG. 10, some embodiments of a wellbore servicing system having at least one receiving tool and a transmitting tool communicating via a triggering signal is illustrated. In the embodiment of FIG. 10 the wellbore servicing system comprises an embodiment of a wellbore servicing system 460, for example, a system generally configured to perform one or more wellbore servicing operations, for example, the stimulation of one or more zones of a subterranean formation, for example, a fracturing, perforating, hydrojetting, acidizing, a system generally configured to perform at least a portion of a production operation, for example, the production of one or more fluids from a subterranean formation and/or one or more zones thereof, or a like system. Additionally, the wellbore servicing system 460 may be configured to log/measure data from within a wellbore or any other suitable wellbore servicing operation as will be appreciated by one of ordinary skill in the art upon viewing this disclosure.

In the embodiment of FIG. 10, the wellbore servicing system 460 comprises one or more stationary receiving tools 462 (particularly, stationary receiving tools 462*a*, 462*b*, and 462*c*, for example, each comprising a receiver system, as disclosed with respect to FIG. 3) disposed within the wellbore 114. While the embodiment of FIG. 10 illustrates an embodiment in which there are three stationary receiving tools 462, any suitable number of stationary receiving tools 462 may be employed. In the embodiment of FIG. 10, each of the stationary receiving tools 462 may be generally configured for the performance of a subterranean formation stimulation treatment, for example, via the selective delivery of a wellbore servicing fluid into the formation. For example, each of the stationary receiving tools 462 may comprise an AFA, such that each of the stationary receiving tools 462 may be selectively caused to allow, disallow, or alter a route of fluid communication between the wellbore (e.g., between the axial flowbore 191 of the casing 190) and one or more subterranean formation zones, such as formation zones 2, 4, and 6. The stationary receiving tools 462 may be configured to deliver such a wellbore servicing fluid at a suitable rate and/or pressure. In some embodiments, one or more of the stationary receiving tools 462 may be configured to measure and/or to log data from within the wellbore 114. For example, one or more of the stationary receiving tools 462 may comprise one or more transducers and/or a memory device. Further, one or more of the stationary receiving tools 462 may be configured to perform any other suitable wellbore servicing operation as will be appreciated by one of ordinary skill in the art upon viewing this disclosure.

Also in the embodiment of FIG. 10, the wellbore servicing system 460 further comprises a transitory transmitting tool 464 (e.g., comprising a transmitter system, as disclosed with respect to FIG. 9). In the embodiment of FIG. 10, the transitory transmitting tool 464 is generally configured to transmit one or more triggering signals to one or more of the stationary receiving tools 462 effective to activate the switching system 202 of one or more of the stationary receiving tools 462 to output a given response, for example, to actuate the stationary receiving tool 462. In the embodiment of FIG. 10, the transitory transmitting tool 464 comprises a ball, for example, such that the transitory transmitting tool 464 may be communicated through the casing 190. Further, the transitory transmitting tool 464 may comprise any suitable type or configuration, for example, a work string member.

In some embodiments, a wellbore servicing system such as the wellbore servicing system 460 disclosed with respect to FIG. 10 may be employed in the performance of a wellbore servicing operation, for example, a wellbore stimulation operation, such as a fracturing operation, a perforating operation, a hydrojetting operation, an acidization operation, or combinations thereof. In some embodiments, the wellbore servicing system 460 may be employed to measure and/or to log data, for example, for data collection purposes. Further, the wellbore servicing system 460 may be employed to perform any other suitable wellbore servicing operation as will be appreciated by one of ordinary skill in the art upon viewing this disclosure. In some embodiments, such a wellbore stimulation operation may generally comprise the steps of positioning one or more stationary receiving tools within a wellbore, communicating a transitory transmitting tool transmitting a triggering signal through the wellbore, sensing the triggering signal to activate a switching system of one or more of the stationary receiving tools, and optionally, repeating the process of activating a switching system of one or more additional stationary receiving tools with respect to one or more additional transitory tools.

Referring again to FIG. 10, in some embodiments, one or more stationary receiving tools 462 may be positioned within a wellbore, such as wellbore 114. For example, in the embodiment of FIG. 10 where the stationary receiving tools 462 are incorporated within the casing 190, the stationary receiving tools 462 may be run into the wellbore 114 (e.g., positioned at a desired location within the wellbore 114) along with the casing 190. Additionally, during the positioning of the stationary receiving tools 462, the stationary receiving tools 462 are in the inactive state.

In some embodiments, a transitory transmitting tool 464 may be introduced in the wellbore 114 (e.g., into the casing 190) and communicated downwardly through the wellbore 114. For example, in some embodiments, the transitory transmitting tool 464 may be communicated downwardly through the wellbore 114, for example, via the movement of a fluid into the wellbore 114 (e.g., the forward-circulation of a fluid). As the transitory transmitting tool 464 is communicated through the wellbore 114, the transitory transmitting tool 464 comes into signal communication with one or more stationary receiving tools 462, for example, one or more of the stationary receiving tools 462*a*, 462*b*, and 462*c*, respectively. In some embodiments, as the transitory transmitting tool 464 comes into signal communication with each of the stationary receiving tools 462, the transitory transmitting tool 464 may transmit a triggering signal to the stationary receiving tools 462.

In some embodiments, the triggering signal may be sufficient to activate one or more stationary receiving tools 462. For example, one or more switching systems 202 of the stationary receiving tools 462 may transition from the inactive state to the active state in response to the triggering signal. In some embodiments, upon activating a stationary receiving tool 462, the switching system 202 may provide power to the electrical load 208 coupled with the stationary receiving tool 462. For example, the electrical load 208 may comprise an electronic actuator which actuates (e.g., from a closed position to an open position or vice-versa) in response to receiving power from the switching system 202. As such, upon actuation of the electronic actuator, the stationary receiving tool 462 may transition from a first configuration to a second configuration, for example, via the transitioning one or more components (e.g., a valve, a sleeve, a packer element, etc.) of the stationary receiving tool 462. The electrical load 208 may comprise a transducer and/or a microcontroller which measures and/or logs wellbore data in response to receiving power from the switching system 202. Further, the electrical load 208 may comprise a transmitting system (e.g., transmitting system 400) and may begin communicating a signal (e.g., a triggering signal, a near field communication (NFC) signal, a radio frequency identification (RFID) signal, etc.) in response to providing power to the electrical load 208. The stationary receiving tool 462 may employ any suitable electrical load 208 as would be appreciated by one of ordinary skill in the art upon viewing this disclosure.

In some embodiments, the switching system 202 of one or more of the stationary tools 462 is configured such that the stationary receiving tool 462 will remain in the active state (e.g., providing power to the electrical load 208) for a predetermined duration of time. In some embodiments, following the predetermined duration of time, the switching system 202 may transition from the active state to the inactive state and, thereby no longer provide power to the electrical load 208. For example, the switching system 202 may be coupled to a processor and the processor may apply a voltage signal to the power disconnection portion 212 of the switching system 202 following a predetermined duration of time.

In some embodiments, the switching system 202 of one or more of the stationary receiving tools 462 is coupled to a processor and is configured to increment or decrement a counter (e.g., a hardware or software counter) upon activation of the switching system 202. For example, in some embodiments, following a predetermined duration of time after incrementing or decrementing a counter, the switching system 202 may transition from the active state to the inactive state while a predetermined numerical value is not achieved. Additionally, the stationary tool 462 may perform one or more wellbore servicing operations (e.g., actuate an electronic actuator) in response to the counter transitioning to a predetermined numerical value (e.g., a threshold value).

In some embodiments, the switching system 202 of one or more of the stationary tools 462 is configured such that the stationary receiving tool 462 will remain in the active state (e.g., providing power to the electrical load 208) until receiving a second triggering signal. For example, the switching system 202 is configured to activate the power disconnection portion 212 in response to a second triggering signal to deactivate the feedback portion 290, as previously disclosed.

In some embodiments, the stationary receiving tool 462 comprises a transducer, the switching system 202 may transition from the active state to the inactive state in response to one or more wellbore conditions. For example, upon activating the transducer (e.g., via activating the switching system 202), the transducer (e.g., a temperature sensor) may obtain data (e.g., temperature data) from within the wellbore 114 and the stationary receiving tool 462 may transition from the active state to the inactive state until one or more wellbore conditions are satisfied (e.g., a temperature threshold). Further, the duration of time necessary for the switching system 202 to transition from the active state to the inactive state may be a function of data obtained from within the wellbore 114.

In some embodiments, an additional tool (e.g., a ball, a dart, a wire line tool, a work string member, etc.) may be introduced to the wellbore servicing system 460 (e.g., within the casing 190) and may be employed to perform one or more wellbore servicing operations. For example, the additional tool may engage the stationary receiving tool 462 and may actuate (e.g., further actuate) the stationary receiving tool 462 to perform one or more wellbore servicing operations. As such, the one or more transitory transmitting tool 464 may be employed to incrementally adjust a stationary receiving tool 462, for example, to adjust a flow rate and/or degree of restriction (e.g., to incrementally open or close) of the stationary receiving tool 462 in a wellbore production environment.

In some embodiments, one or more steps of such a wellbore stimulation operation may be repeated. For example, one or more additional transitory transmitting tools 464 may be introduced in the wellbore 114 and may transmit one or more triggering signals to one or more of the stationary receiving tools 462, for example, for the purpose of providing power to one or more additional electrical load 208 (e.g., actuators, transducers, electronic circuits, transmitter systems, receiver systems, etc.).

Referring to FIG. 11, a wellbore servicing system having at least two nodes communicating via a triggering signal is illustrated. In the embodiment of FIG. 11 the wellbore servicing system comprises an embodiment of a wellbore servicing system 470, for example, a system generally configured for the stimulation of one or more zones of a subterranean formation. Additionally, the wellbore servicing system 470 may be configured to log/measure data from within a wellbore or any other suitable wellbore servicing operation as will be appreciated by one of ordinary skill in the art upon viewing this disclosure.

In the embodiment of FIG. 11, the wellbore servicing system 470 comprises a transitory transceiver tool 474 (e.g., a ball or dart, for example, each comprising a receiver system, as disclosed with respect to FIG. 3, and a transmitter system, as disclosed with respect to FIG. 9) and one or more stationary receiving tools 472 (particularly, three stationary receiving tools, 472*a*, 472*b*, and 472*c*, for example, comprising a receiver system, as disclosed with respect to FIG. 3) disposed within the wellbore 114. While the embodiment of FIG. 11 illustrates an embodiment in which there are three stationary receiving tools 472, however, any suitable number of stationary receiving tools may be employed.

In the embodiment of FIG. 11, each of the stationary receiving tools 472 is incorporated within (e.g., a part of) the casing 190 and is positioned within the wellbore 114. In some embodiments, each of the stationary receiving tools 472 is positioned within the wellbore such that each of the stationary receiving tools 472 is generally associated with a subterranean formation zone. In some embodiments, each of the stationary receiving tools 472*a*, 472*b*, and 472*c*, may thereby obtain and/or comprise data relevant to or associated with each of zones, respectively. In some embodiments, one or more of the stationary receiving tools 472 may be configured to measure and/or to log data from within the wellbore 114. For example, one or more of the stationary receiving tool 472 may comprise one or more transducers and/or a memory device. Alternatively, one or more of the stationary receiving tools 472 may be configured to perform any other suitable wellbore servicing operation as will be appreciated by one of ordinary skill in the art upon viewing this disclosure.

Also in the embodiment of FIG. 11, the wellbore servicing system 470 further comprises a transmitting activation tool 476 (e.g., comprising a transmitter system, as disclosed with respect to FIG. 9). In the embodiment of FIG. 11, the transmitting activation tool 476 is generally configured to transmit a triggering signal to the transitory transceiver tool 474. In the embodiment of FIG. 11, the transmitting activation tool 476 is incorporated within the casing 190 at a location uphole relative to the stationary receiving tools 472 (e.g., uphole from the "heel" of the wellbore 114 or substantially near the surface 104). Further, a transmitting activation tool 476 may be positioned at the surface (e.g., not within the wellbore). For example, the transmitting activation tool 476 may be a handheld device, a mobile device, etc. The transmitting activation tool 476 may be and/or incorporated with a rig-based device, an underwater device, or any other suitable device as would be appreciated by one of ordinary skill in the art upon viewing this disclosure.

Also in the embodiment of FIG. 11, the wellbore servicing system 470 comprises a transitory transceiver tool 474 (e.g., comprising a receiver system, as disclosed with respect to FIG. 3, and a transmitter system, as disclosed with respect to FIG. 9). In the embodiment of FIG. 11, the transitory transceiver tool 474 is generally configured to receive a triggering signal from the transmitting activation tool 476 and thereby transition the transitory transceiver tool 474 from an inactive state to an active state. Additionally, upon transitioning to the active state, the transitory transceiver tool 474 is generally configured to transmit one or more triggering signals to one or more of the stationary receiving tools 472 effective to activate the switching system of one or more of the stationary receiving tools 472 to output a given response, for example, to actuate the stationary receiving tool 472. Further, the transitory transceiver tool 474 is generally configured to transmit one or more NFC signals, RFID signals, a magnetic signal, or any other suitable wireless signal as would be appreciated by one of ordinary skill in the art upon viewing this disclosure. In the embodiment of FIG. 11, the transitory transceiver tool 474 comprises a ball, for example, such that the transitory transceiver tool 474 may be communicated through the casing 190 via the axial flowbore 191 thereof.

In some embodiments, the wellbore servicing system such as the wellbore servicing system 470 disclosed with respect to FIG. 11 may be employed to provide a two stage activation of one or more tools (e.g., the transitory transceiver tool). In some embodiments, the wellbore servicing system 470 may be employed to measure and/or to log data, for example, for data collection purposes. Further, the wellbore servicing system 470 may be employed perform to any other suitable wellbore servicing operation as will be appreciated by one of ordinary skill in the art upon viewing this disclosure. For example, such a wellbore servicing method may generally comprise the steps of positioning one or more stationary receiving tools within a wellbore, providing an transmitting activation tool, communicating a transitory transceiver tool through at least a portion of the wellbore, sensing a first triggering signal to activate a switching system of the transitory transceiver tool, sensing a second triggering signal to activate a switching system of one or more of the stationary receiving tools, and optionally, repeating the process of activating a switching system of one or more additional stationary receiving tools, for example, via one or more additional transitory transceiver tools.

Referring again to FIG. 11, in some embodiments, one or more stationary receiving tools 472 may be positioned within a wellbore, such as wellbore 114. For example, in the embodiment of FIG. 11 where the stationary receiving tools 472 are incorporated within the casing 190, the stationary receiving tools 472 may be run into the wellbore 114 (e.g., positioned at a desired location within the wellbore 114) along with the casing 190. Additionally, during the positioning of the stationary receiving tools 472, the stationary receiving tools 472 are in the inactive state.

Additionally, in some embodiments, one or more transmitting activation tools 476 may be positioned within a wellbore, such as wellbore 114. For example, in the embodiment of FIG. 11 the transmitting activation tool 476 is incorporated within the casing 190, the transmitting activation tool 476 may be run into the wellbore 114 (e.g., positioned at an uphole location with respect to one or more stationary receiving tools 472 within the wellbore 114) along with the casing 190. In some embodiments, the transmitting activation tool 476 is configured to transmit a first triggering signal.

In some embodiments, a transitory transceiver tool 474 may be introduced into the wellbore 114 (e.g., into the casing 190) in an inactive state and communicated downwardly through the wellbore 114. For example, in some embodiments, the transitory transceiver tool 474 may be communicated downwardly through the wellbore 114, for example, via the movement of a fluid into the wellbore 114 (e.g., the forward-circulation of a fluid). As the transitory transceiver tool 474 is communicated through the wellbore 114, the transitory transceiver tool 474 comes into signal communication with the transmitting activation tool 476. In some embodiments, as the transitory transceiver tool 474 comes into signal communication with the transmitting activation tools 476, the transitory transceiver tool 474 may experience and/or receive the first triggering signal from the transmitting activation tool 476. In some embodiments, the transitory transceiver tool 474 may be activated at the surface (e.g., prior to being disposed within the wellbore 114), for example, where the transmitting activation tool 474 is a handheld device, a mobile device, etc.

In some embodiments, the triggering signal may be sufficient to activate the transitory transceiver tool 474. For example, the switching systems 202 of the transitory transceiver tool 474 may transition from the inactive state to the active state in response to the triggering signal. In some embodiments, upon activating the transitory transceiver tool 474, the switching system 202 may provide power to the electrical load 208 coupled with the transitory transceiver tool 474. For example, the transitory transceiver tool 474 comprises a transmitter system 400 which begin generating and/or transmitting a second triggering signal in response to receiving power from the switching system 202.

In some embodiments, the second triggering signal may be sufficient to activate one or more stationary receiving tools 472. For example, one or more switching systems 202 of the stationary receiving tools 472 may transition from the inactive state to the active state in response to the triggering signal. In some embodiments, upon activating a stationary receiving tool 472, the stationary receiving tool 472 may provide power to the electrical load 208 coupled with the stationary receiving tool 472. For example, the electrical load 208 may comprise an electronic actuator which actuates (e.g., from a closed position to an open position or vice-versa) in response to receiving power from the switching system 202. As such, upon actuation of the electronic actuator, the stationary receiving tool 472 may transition from a first configuration to a second configuration, for example, via the transitioning one or more components (e.g., a valve, a sleeve, a packer element, etc.) of the stationary receiving tool 472. Further, the electrical load 208 may comprise a transducer and/or a microcontroller which measures and/or logs wellbore data in response to receiving power from the switching system 202. The electrical load 208 may comprise a transmitting system (e.g., transmitting system 400) and may begin communicating a signal (e.g., a triggering signal, a NFC signal, a RFID signal, etc.) in response to providing power to the electrical load 208. Additionally, the stationary receiving tool 472 may employ any suitable electrical load 208 as would be appreciated by one of ordinary skill in the art upon viewing this disclosure.

In some embodiments, one or more steps of such a wellbore stimulation operation may be repeated. For example, one or more additional transitory transceiver tool 474 may be introduced in the wellbore 114 in an inactive state and may become activated to transmit one or more triggering signals to one or more of the stationary receiving tools 472, for example, for the purpose of providing power to one or more additional electrical load 208 (e.g., actuators, transducers, electronic circuits, transmitter systems, receiver systems, etc.).

Referring to FIG. 12, a wellbore servicing system having a receiving tool and a transmitting tool communicating via a triggering signal is illustrated. In the embodiment of FIG. 12, the wellbore servicing system comprises an embodiment of a wellbore servicing system 430, for example, a system generally configured for the stimulation of one or more zones of a subterranean formation, for example, a perforating system.

In the embodiment of FIG. 12, the wellbore servicing system 430 comprises a transitory receiving tool 432 (e.g., comprising a receiver system, as disclosed with respect to FIG. 3) incorporated within a work string 435 (e.g., a coiled tubing string, a jointed tubing string, or combinations thereof). Further, the transitory receiving tool 432 may be similarly incorporated within (e.g., attached to or suspended from) a wireline (e.g., a slickline, a sandline, etc.) or the like. In the embodiment of FIG. 12, the transitory receiving tool 432 may be configured as a perforating tool, for example, a perforating gun. In some embodiments, the transitory receiving tool 432 (e.g., a perforating gun) may be configured to perforate a portion of a well and/or a tubular string (e.g., a casing string) disposed therein. For example, in some embodiments, the perforating gun may comprise a plurality of shaped, explosive charges which, when detonated, will explode outwardly into the tubular string and/or formation so as to form a plurality of perforations.

In the embodiment of FIG. 12, the wellbore servicing system 430 also comprises a transmitting activation tool 434 e.g., comprising a transmitter system, as disclosed with respect to FIG. 9). In the embodiment of FIG. 12, the transmitting activation tool 434 is incorporated within the casing 190 at desired location within the wellbore 114. For example, in various embodiments, the transmitting activation tool 434 may be located at a depth slightly above or substantially proximate to a location at which it is desired to introduce a plurality of perforations. Further, the transmitting activation tool 434 may be located at any suitable depth within the wellbore 114 or distance along a wellbore 114 (e.g., a horizontal portion of a wellbore), for example, a depth of approximately 10 ft. to 15,000 ft. In an additional embodiment, a wellbore servicing system may comprise one or more additional activation tools, like the transmitting activation tool 434, incorporated within the casing string at various locations.

In some embodiments, a wellbore servicing system such as the wellbore servicing system 460 disclosed with respect to FIG. 12 may be employed for the stimulation of one or more zones of a subterranean formation, for example, a perforating system. For example, such a wellbore servicing method may generally comprise the steps of positioning a transmitting activation tool within a wellbore, communicating a transitory receiving tool through at least a portion of the wellbore, sensing a triggering signal to activate a switching system of the transitory receiving tool, and retrieving the transitory receiving tool to deactivate the transitory receiving tool.

In some embodiments, one or more transmitting activation tools 434 may be positioned within a wellbore, such as wellbore 114. For example, in the embodiment of FIG. 12 the transmitting activation tool 434 is incorporated within the casing 190, the transmitting activation tool 434 may be run into the wellbore 114 (e.g., positioned at a desired location within the wellbore 114) along with the casing 190. In some embodiments, the transmitting activation tool 434 is configured to transmit a triggering signal.

In some embodiments, a transitory receiving tool 432 may be introduced in the wellbore 114 (e.g., into the casing 190) in an inactive state and communicated downwardly through the wellbore 114. For example, in some embodiments, the transitory receiving tool 432 may be communicated downwardly through the wellbore 114, for example, via the movement of a work string 435 into the wellbore 114. As the transitory receiving tool 432 is communicated through the wellbore 114, the transitory receiving tool 432 comes into signal communication with the transmitting activation tool 434. In some embodiments, as the transitory receiving tool 432 comes into signal communication with the transmitting activation tools 434, the transitory receiving tool 432 may experience and/or receive the triggering signal from the transmitting activation tool 432.

In some embodiments, the triggering signal may be sufficient to activate the transitory receiving tools 432. For example, the switching systems 202 of the transitory receiving tool 432 may transition from the inactive state to the active state in response to the triggering signal. In some embodiments, upon activating the transitory receiving tool 432, the switching system 202 may provide power to the electrical load 208 coupled with the transitory receiving tool 432. For example, the electrical load 208 may comprise a perforating gun which may be activated (e.g., capable of firing) in response to receiving power from the switching system 202. Further, the transitory receiving tool 432 may employ any suitable electrical load 208 as would be appreciated by one of ordinary skill in the art upon viewing this disclosure. Additionally, upon providing power to the electrical load 208, the transitory receiving tool 432 may perform one or more wellbore servicing operations, for example, perforating the casing 190.

In some embodiments, upon the completion of one or more wellbore servicing operations, the transitory receiving tool 432 may be communicated upwardly through the wellbore 114. As the transitory receiving tool 432 is communicated upwardly through the wellbore 114, the transitory receiving tool 432 comes into signal communication with the transmitting activation tool 434. In some embodiments, as the transitory receiving tool 432 comes into signal communication with the transmitting activation tools 434, the transitory receiving tool 432 may experience and/or receive a second triggering signal from the transmitting activation tool 432. In some embodiments, the triggering signal may be sufficient to transition the transitory receiving tool 432 to the inactive state (e.g., to deactivate the transitory receiving tool 432 such that the perforating gun is no longer capable of firing). For example, the switching systems 202 of the transitory receiving tool 432 may transition from the active state to the inactive state in response to the second triggering signal.

In some embodiments, one or more steps of such a wellbore stimulation operation may be repeated. For example, one or more additional transitory receiving tool 432 may be introduced in the wellbore 114 in an inactive state and may be activated to perform one or more wellbore servicing operations. Following one or more wellbore servicing operations the transitory receiving tool 432 may be transitioned to the inactive state upon being retrieved from the wellbore 114.

In some embodiments, a tool, a wellbore servicing system comprising one or more tools, a wellbore servicing method employing such a wellbore servicing system and/or such a tool, or combinations thereof may be advantageously employed in the performance of a wellbore servicing operation. In some embodiments, employing such a tool comprising a switching system enables an operator to further reduce power consumption and increase service life of a tool. Additionally, employing such a tool comprising a switching system enables an operator to increase safety during the performance of one or more hazardous or dangerous wellbore servicing operations, for example, explosive detonation, perforation, etc. For example, a tool may be configured to remain in an inactive state until activated by a triggering signal. Conventional tools and/or wellbore servicing systems may not have the ability to wirelessly induce an electrical response to complete a switching circuit and thereby transition from an inactive state where substantially no power (e.g., less power consumed than a "sleep" or idle state) is consumed to an active state. As such, a switching system may be employed to increase the service life of a tool, for example, to allow a tool to draw substantially no power until activated (e.g., via a triggering signal) to perform one or more wellbore servicing operations and thereby increasing the service life of the tool. Additionally, such a switching system may be employed to increase safety during the performance of one or more hazardous or dangerous wellbore servicing operations, for example, to allow an operator to activate hazardous equipment remotely.

In some embodiments, the tools 140, discussed with reference to FIGS. 1A and 1B, may be configured as a receiving system 200, discussed with reference to FIGS. 2 and 3. As such, the tool 140 may be configured to consume substantially no power in an inactive state until transitioned to an active state. An inactive state may exist when a circuit is incomplete and circuit flow between a power supply and an electrical load is disallowed. For example, a battery may be installed as a part of the tool 140 in the wellbore tubular 180. As noted above the wellbore tubular 180 may represent a drill string, wireline system, production tubing, a casing, a riser, a completion string, a lubricator, or any other suitable wellbore component. However, if the battery is connected to the tool prior to installation in the wellbore tubular 180, power is being consumed even while the tool is not being operated. For example, approximately 3 milliamperes (mA) may be continuously consumed even while the tool is in sleep mode. Further, the tools 140 may be assembled and then stored for extended time periods prior to use. Thus, in some embodiments, a tool 140 may be configured to be in an inactive state and consume substantially no power (except for battery self-discharge) until the tool 140 is transitioned to an active state.

In some embodiments, the tool 140 may be configured as a transmitter system 400, discussed above with reference to FIGS. 8 and 9. As such, the tool 140 may be utilized to wirelessly activate other downhole tools. For example, the tool 140 in wellbore tubular 180 may be utilized to transmit a triggering signal to the stationary receiving tools 462 and 472, discussed with reference to FIGS. 10 and 11, respectively.

Transitioning the tool 140, configured as a receiving system 200, to an active state may be accomplished by a transmitter system 400, discussed above with reference to FIGS. 8 and 9. The transmitter system 400 may be utilized to wirelessly activate the tool 140 using magnetic coupling, inductive coupling, acoustic coupling, electrical coupling, or any other suitable activation mechanism. The transmitter system 400 may be configured to transmit a triggering signal to the tool 140 to transition the tool 140 to an active state. The tool 140 may be activated at servicing rig 106, at the earth's surface 104, at the rig floor 110, prior to or while inserting the drill string 102 into the wellbore 114. Activating the tool 140 just prior to or while inserting the drill string 102 into the wellbore 114 may result in an extended operational life for the tool 140 because the tool 140 may not consume significant amounts of power from the power supply 204 (e.g., a battery) until the tool 140 is activated and ready to be operated in the wellbore 114. FIGS. 13A-16 illustrate example systems for transitioning the tool 140 from an inactive state to an active state.

Figure 13A:
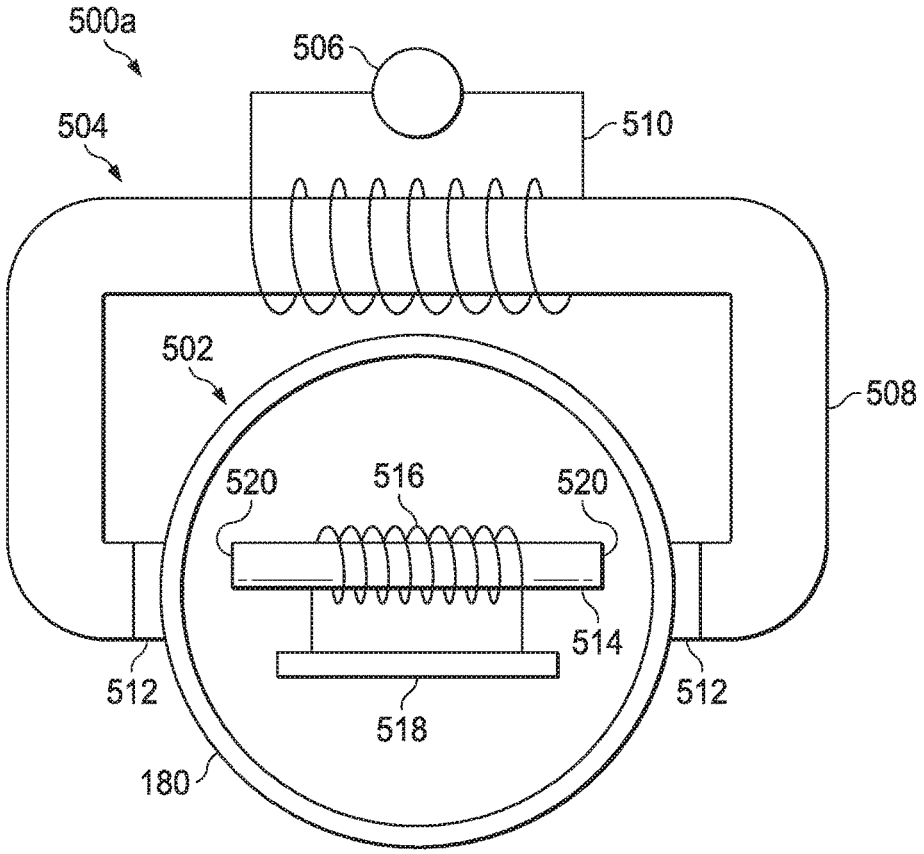
FIGS. 13A and 13B are exemplary in-line magnetic coupling systems.
Figure 13B:
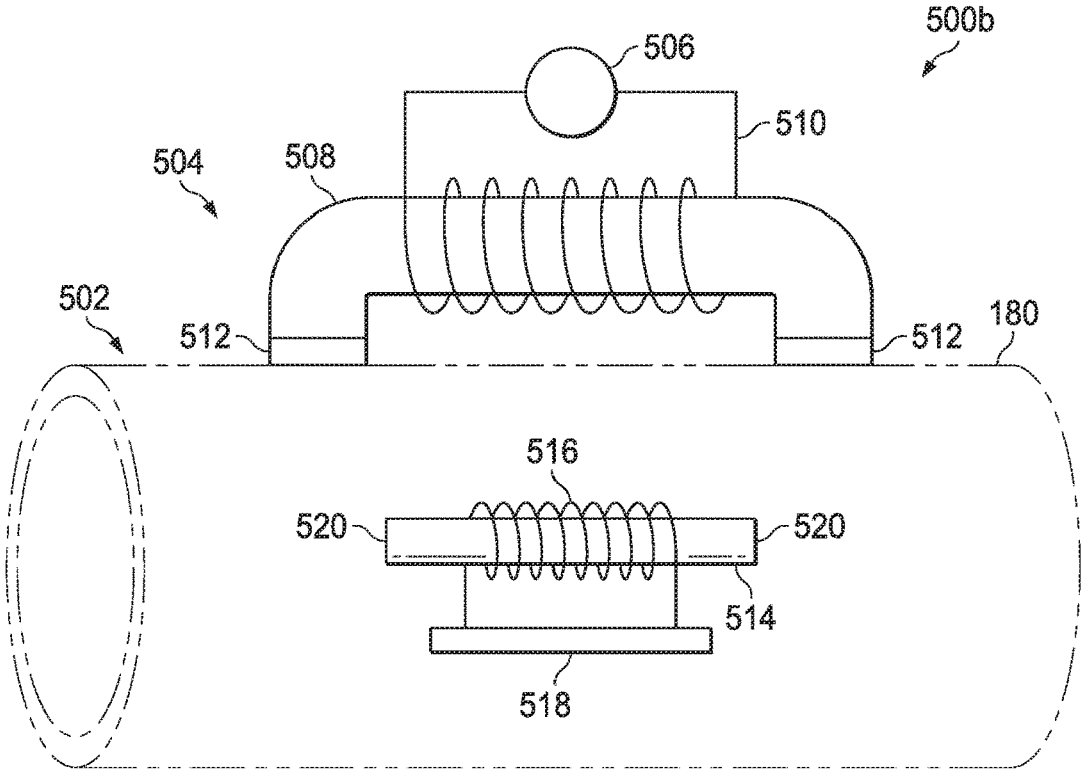

FIGS. 13A and 13B are exemplary in-line magnetic coupling systems 500. The receiving tool 502 may be any of various types of sensors, actuators, telemetry devices, or other devices that may include a non-activated power supply and a switch. The receiving tool 502 may be located completely or partially inside a housing 150 and/or the wellbore tubular 180. The wellbore tubular 180 may be welded or otherwise permanently sealed at the location of the receiving tool 502. For example, the receiving tool 502 may be a sensor that may be welded inside the wellbore tubular 180. The receiving tool 502 may be oriented in any direction within wellbore tubular 180. For example, the receiving tool 502 may be oriented substantially perpendicular to length of the wellbore tubular 180 as shown in the system 500*a*. As another example, the receiving tool 502 may be oriented substantially parallel to the length of the wellbore tubular 180 as shown in the system 500*b*. In some embodiments, the receiving tool 502 may have any orientation as long as the orientation is communicated to an operator or apparatus utilizing the transmitting activation tool 504.

In some embodiments, the transmitting activation tool 504 may be a transmitter system 400, shown with reference to FIG. 8, configured to transmit a triggering signal to the receiving tool 502. As such, the transmitting activation tool 504 may include a power supply 506 and a transmitting unit that may include an activator core 508 and an activator winding 510. The activator core 508 may be configured to support the activator winding 510 and may include the activator ends 512. Accordingly, the transmitting activation tool 504 may be configured as an electromagnet.

In some embodiments, the receiving tool 502 may be a receiving system 200, shown with reference to FIG. 2, configured to receive a triggering signal from the transmitting activation tool 504. As such, the receiving tool 502 may include a receiving unit, which may include a tool core 514, a tool winding 516, and an electronic circuit 518, which may include a power supply, a switching system, and an electrical load, as discussed with reference to FIG. 2. The tool core 514 may be configured to support the tool winding 516, and may include the tool ends 520.

During operation, the activator ends 512 may be positioned proximate to the tool ends 520 of the tool core 514 and may generate an electromagnetic triggering signal. The triggering signal induces an electrical current to be generated via an electromagnetic coupling between the activator ends 512 and the tool ends 520. In some embodiments, the induced electrical response may be effective to activate one or more electronic switches of the receiving tool 502 to allow one or more routes of electrical current flow within the receiving tool 502 to supply power to the electrical load. Activating an electronic switch of the receiving tool 502 transitions the receiving tool 502 from an inactive state to an active state.

In some embodiments, the activator core 508 and the tool core 514 may be composed of a material that may have a high magnetic permeability, such as a permanent magnet. For example, the core may be composed of magnetic transition metals and transition metal alloys, particularly annealed (soft) iron or a permalloy (sometimes referred to as a "MuMetal"), which are a family of Ni—Fe—Mo alloys, ferrite, or any other alloy or combination of alloys that exhibits ferromagnetic properties. The activator core 508 and the tool core 514 may include more than one type of alloy to support a variable magnetic flux density ($Wb/m^2$) when exposed to variations in the reluctance of the magnetic circuit.

The activator winding 510 and the core winding 516 may be wrapped directly onto the activator core 508 and the tool core 514, respectively, or may be wrapped on a bobbin. In some embodiments, the activator winding 510 and the tool winding 516 may be configured to maximize the number of turns on the activator core 508 and the tool core 514, respectively, to optimize performance of the transmitting activation tool 504 and the receiving tool 502. The activator winding 510 and the core winding 516 may be a magnetic wire that includes an insulator and a conductor. For example, the activator winding 510 or the tool winding 516 may be varnish coated round copper wire, square silver wire, copper drawn wire with a thin dielectric coating on it like polyimide, a ceramic, and/or any other suitable wire and insulation. As example, selection of material for the tool winding 516 may be partially based on high temperatures associated with installation of the receiving tool 502 within a housing 150 and/or the wellbore tubular 180, e.g., welding temperatures. For example, a ceramic may suitably withstand welding temperatures during assembly. In some embodiments, the tool winding 516 may utilize a thermal insulator, such as a ceramic tube, to protect tool winding 516 and other components while welding or other sealing operation occurs to install the receiving tool 502 in the wellbore tubular 180.

As an example in system 500*a*, the power supply 506 may be a low-voltage, high-current AC signal with a drive frequency of approximately 60 Hz. The wellbore tubular 180 may be an electrically conductive but non-ferromagnetic aluminum metal plate, stainless steel, or nickel alloy. In such a configuration, the tool core 514 and the tool winding 516 (e.g., the receiving tool electromagnet) may receive sufficient power to transition the receiving tool 502 from an inactive state to an active state. However, in some embodiments, wellbore tubular 180 may be electrically insulating, such as composed of fiber reinforced composite or ceramic.

Figure 14:
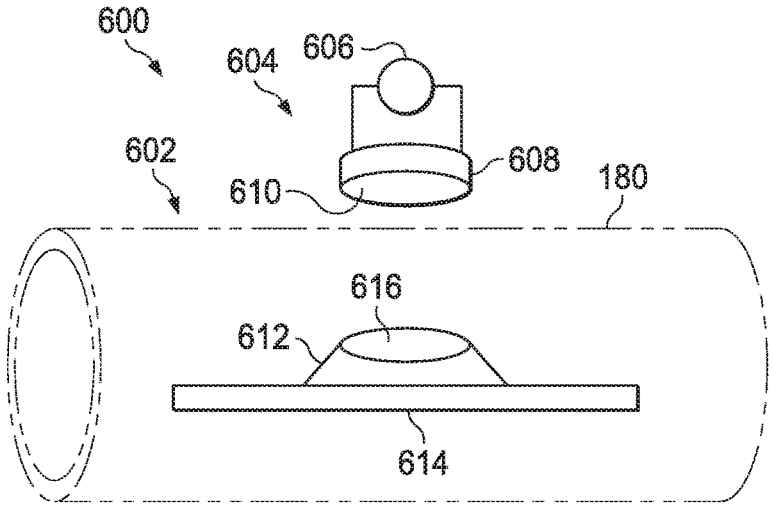
FIG. 14 is an exemplary inductive (magnetic) coupling system.

FIG. 14 is an exemplary inductive (magnetic) coupling system 600. The receiving tool 602 may be any of various types of sensors, actuators, telemetry devices, or any other device that may include a non-activated power supply and a switch. The receiving tool 602 may be located completely or partially inside a housing 150 and/or the wellbore tubular 180. The wellbore tubular 180 may be welded or otherwise permanently sealed at the location of the receiving tool 602. For example, the receiving tool 602 may be a sensor that may be welded inside the wellbore tubular 180. The receiving tool 602 may be oriented in any orientation within the wellbore tubular 180. For example, the receiving tool 602 may be oriented substantially parallel to length of the wellbore tubular 180 as shown in orientation 600. In some embodiments, the receiving tool 602 may have any configuration or orientation as long as the configuration or orientation is communicated to an operator of the transmitting activation tool 604.

In some embodiments, the transmitting activation tool 604 may be a transmitter system 400, shown with reference to FIG. 8, configured to transmit a triggering signal to the receiving tool 602. As such, the transmitting activation tool 604 may include a power supply 606 and a transmitting unit that may include an activator coil 608. The activator coil 608 may be configured to support a core and winding, and may include an activator face 610. As noted previously, electromagnetic resonance may also be utilized to increase energy coupling efficiency at a resonant frequency.

In some embodiments, the receiving tool 602 may be a receiving system 200, shown with reference to FIG. 2, configured to receive a triggering signal from the transmitting activation tool 604. As such, the receiving tool 602 may include a receiving unit, which may include a tool coil 612 and an electronic circuit 614, which may include a power supply, a switching system, and an electrical load, as discussed with reference to FIG. 2. The tool coil 612 may be configured to support a core and a winding and may include a tool face 616.

During operation, the activator face 610 may be positioned proximate to the tool face 616 and may generate a triggering signal. The triggering signal induces an electrical current to be generated via an inductive coupling between the activator face 610 and the tool face 616. In some embodiments, the induced electrical response may be effective to activate one or more electronic switches of the receiving tool 602 to allow one or more routes of electrical current flow within the receiving tool 602 to supply power to the electrical load.

The activator coil 608 and the tool coil 612 may include a core that supports a winding mounted or wrapped around the core. The core may be composed of a material that may have a high magnetic permeability, such as a permanent magnet. For example, the core may be composed of magnetic transition metals and transition metal alloys, particularly annealed (soft) iron or a permalloy (sometimes referred to as a "MuMetal"), which are a family of Ni—Fe—Mo alloys, ferrite, or any other alloy or combination of alloys that exhibits ferromagnetic properties. The winding may be wrapped directly onto the core or may be wrapped on a bobbin. The winding may be a magnetic wire that includes an insulator and a conductor. For example, the winding may be varnish coated round copper wire, square silver wire, copper drawn wire with a thin dielectric coating, or any other suitable material.

In some embodiments, the inductive coupling of system 600 operates by generating an AC magnetic field in the transmitting activation tool 604. The receiving tool 602 receives the magnetic field and converts the AC magnetic field into an AC electrical field. The efficiency of system 600 may be limited by eddy current losses in the wellbore tubular 180 or the housing 150. Eddy current losses may be minimized if the wellbore tubular 180 or the housing 150 are composed of an electrically insulating material, such as a composite, silicon added to steel, vitreous metals, titanium, a material based powder metallurgy process, laminated metallic where the laminations disrupt the formation of the eddy currents, or other suitable materials and configurations.

Figure 15:
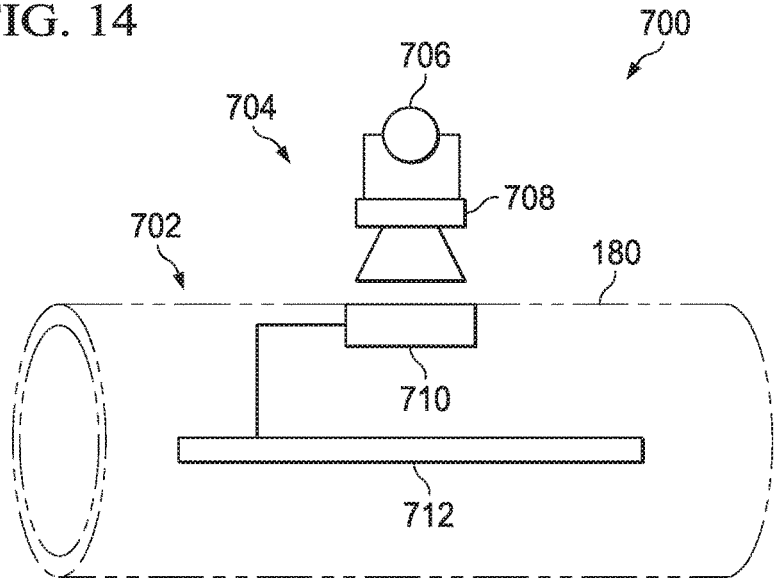
FIG. 15 is an exemplary acoustic coupling system.

FIG. 15 is an exemplary acoustic coupling system 700. The receiving tool 702 may be any of various types of sensors, actuators, telemetry devices, or any other device that may include a non-activated power supply and a switch. The receiving tool 702 may be located completely or partially inside the wellbore tubular 180. The wellbore tubular 180 may be welded or otherwise permanently sealed at the location of the receiving tool 702. For example, the receiving tool 702 may be a sensor that may be welded inside the wellbore tubular 180. The receiving tool 702 may be oriented in any orientation within the wellbore tubular 180. For example, the receiving tool 702 may be oriented substantially parallel to length of the wellbore tubular 180 as shown in system 700. In some embodiments, the receiving tool 702 may have any configuration or orientation as long as the configuration or orientation is communicated to an operator of the transmitting activation tool 704.

In some embodiments, the transmitting activation tool 704 may be a transmitter system 400, shown with reference to FIG. 8, configured to transmit a triggering signal to the receiving tool 702. As such, the transmitting activation tool 704 may include a power supply 706 and a transmitting unit that may include an acoustic source 708. The acoustic source 708 may be a speaker, a piezoelectric vibration, a magnetostrictor, and offset motor, a voice coil, or any other suitable acoustic or vibratory source.

In some embodiments, the receiving tool 702 may be a receiving system 200, shown with reference to FIG. 2, configured to receive a triggering signal from the transmitting activation tool 704. As such, the receiving tool 702 may include a receiving unit, which may include an acoustic receiver 710 and an electronic circuit 712, which may include a power supply, a switching system, and an electrical load, as discussed with reference to FIG. 2. The acoustic receiver 710 may be mounted to the interior surface of the wellbore tubular 180, or may be configured in the housing 150 mounted proximate the interior surface of the wellbore tubular 180.

During operation, the acoustic source 708 may be positioned proximate to the acoustic receiver 710 and may be operated to generate a triggering signal, e.g., a sound or vibration. The triggering signal induces an electrical current to be generated via an acoustic coupling between the acoustic source 708 and the acoustic receiver 710. In some embodiments, the induced electrical response may be effective to activate one or more electronic switches of the receiving tool 702 to allow one or more routes of electrical current flow within the receiving tool 702 to supply power to the electrical load.

Figure 16:
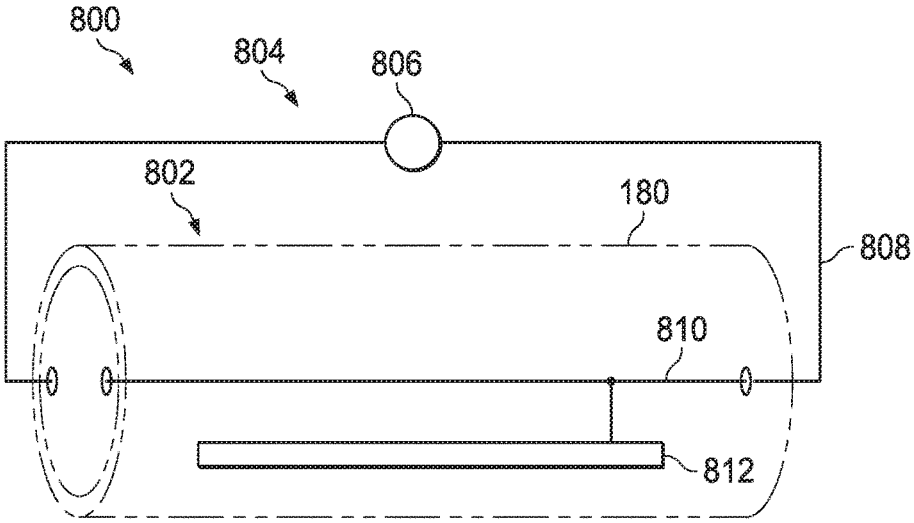
FIG. 16 is an exemplary electrical coupling system.

FIG. 16 is an exemplary electrical coupling system 800. The receiving tool 802 may be any of various types of sensors, actuators, telemetry devices, or any other device that may include a non-activated power supply and a switch. The receiving tool 802 may be located completely or partially inside the wellbore tubular 180. The wellbore tubular 180 may be welded or otherwise permanently sealed at the location of the receiving tool 802. For example, the receiving tool 802 may be a sensor that may be welded inside the wellbore tubular 180. The receiving tool 802 may be oriented in any orientation within the wellbore tubular 180. For example, the receiving tool 802 may be oriented substantially parallel to length of the wellbore tubular 180 as shown in the system 800. In some embodiments, the receiving tool 802 may have any configuration or orientation as long as the configuration or orientation is communicated to an operator of the transmitting activation tool 804.

In some embodiments, the transmitting activation tool 804 may be a transmitter system 400, shown with reference to FIG. 8, configured to transmit a triggering signal to the receiving tool 802. The transmitting activation tool 804 may use electrical coupling and the difference between the electrical conductivity of the wellbore tubular 180 and the receiving tool 802 to transition the receiving tool 802 to an active state. As such, the transmitting activation tool 804 may include a power supply 806 and a transmitting unit that may include wiring 808. The wiring 808 may be configured to apply an alternating current (AC) voltage to the wellbore tubular 180. The wiring 808 may include any type of electrically conductive wire, for example, copper wire.

In some embodiments, the receiving tool 802 may be a receiving system 200, shown with reference to FIG. 2, configured to receive a triggering signal from the transmitting activation tool 804. As such, the receiving tool 802 may include a receiving unit, which may include an electrical receiver 810 and an electronic circuit 812, which may include a power supply, a switching system, and an electrical load, as discussed with reference to FIG. 2. The electrical receiver 810 may be configured as a portion of an electronic circuit 812. The electrical receiver 810 may include any type of electrically conductive wire, for example, copper wire.

During operation, the AC voltage generated by the wiring 808 may generate a current that travels through the housing 150 and/or the wellbore tubular 180 and to the electronic circuit 812. In some embodiments, the electrical resistance of the housing 150 may be greater than the resistance of the electrical receiver 810 and/or the electronic circuit 812. For example, the electrical receiver 810 may comprise copper with a resistivity of approximately 16.8×10-9 ohm-meters. The housing 150 may comprise titanium with a resistivity of approximately 556×10-9 ohm-meters. Thus, a titanium housing 150 has 33 times more resistance than a copper electrical receiver 810 of the same size. The housing 150 has a larger cross-sectional area than the electrical receiver 810, but still provides significant electrical resistance. For example, applying a large current to the housing 150 may create an approximately 0.1 V AC triggering signal. The triggering signal induces an electrical current to be generated via an electrical coupling between the wiring 808 and the electrical receiver 810. In some embodiments, the induced electrical response may be effective to activate one or more electronic switches of the receiving tool 802 to allow one or more routes of electrical current flow within the receiving tool 802 to supply power to the electrical load.

In some embodiments, the tool 140 may be configured as a transceiver tool (e.g., a transmitting/receiving tool) to provide feedback. The tool 140 may be configured to both receive a triggering signal and to transmit a signal. For example, the tool 140 may be configured to transmit a signal, information, data, or a flag regarding the status of the tool 140. The status signal may be an approximately 1 bit or longer signal that indicates that the tool 140 has been activated (e.g., transitioned from an inactive state to an active state). The status signal may be a digitally encoded signal or may be an analog signal. The status signal may be based on modulating a signal with a frequency modulation, an amplitude modulation, a phase shift modulation, a pulse timing modulation, or any other suitable communication method. As another example, the status signal may indicate the status of the electrical load (e.g., sensor) and/or the power supply (e.g., battery), confirmation of a firmware version, parameters of the addressing profile, or any other suitable information. In some embodiments, the data transfer may be bi-directional between the activator and the tool. For example, a user may be able to reprogram the tool, verify new parameters, or any other suitable process. With reference to FIGS. 13A and 13B, a status signal may be accomplished by "shorting" the tool winding 516, which may change the magnetic permeability of the tool core 514. The variation in permeability may be measured by noting the change in the magnetic field outside the housing 150 or the wellbore tubular 180. The shorting may be accomplished by varying the electrical resistance on the winding 516. The magnetic permeability through the core 520 may change depending on whether the ends of the winding 516 have a high electrical impedance (such as during activation of the electronics) or a low electrical impedance (such as using a FET transistor to electrically short circuit the coil). The variations in the magnetic permeability may be registered outside of the tool body by measuring the change in magnetic flux density or the magnetic field.

In some embodiments, the tool 140 may be configured to return to an inactive state. For example, the power disconnection portion 212, discussed with reference to FIG. 3, may be operable to transition the tool 140 to an inactive state. A second triggering signal, information, data, or flag from the transmitting tool may induce the power disconnection portion 212 to deactivate the tool 140. Deactivating the tool 140 may be useful for surface testing of the tool 140. For example, the tool 140 may be activated to ensure the activation occurs properly. The tool 140 may then be deactivated to return to storage or wait before being sent down in a wellbore 114. As another example, the tool 140 may be transitioned to a sleep state and/or an inactive state after a particular amount of time. The activation time for the tool 140 may be controlled by a timer, number of measurements, temperature, or any other suitable parameter. For example, the tool 140 may be transitioned to an active state and determine a temperature is less than a certain level, such as approximately 150 degrees Fahrenheit. The tool 140 may be configured to transition to a sleep state. When the temperature reaches a certain level, the tool 140 may transition to an active state. As another example, the tool 140 may be transitioned to an active state until a particular function is performed and then transition to an inactive state.

While embodiments of the present disclosure have been shown and described, modifications thereof can be made by one skilled in the art without departing from the spirit and teachings of the present disclosure. The embodiments described herein are exemplary only, and are not intended to be limiting. Many variations and modifications of the present disclosure disclosed herein are possible and are within the scope of the present disclosure. Where numerical ranges or limitations are expressly stated, such express ranges or limitations should be understood to include iterative ranges or limitations of like magnitude falling within the expressly stated ranges or limitations (e.g., from approximately 1 to approximately 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc., should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference in the Detailed Description of the Embodiments is not an admission that it is prior art to the present disclosure, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A well tool system comprising:

a receiving tool disposed in a wellbore tubular, the receiving tool including a magnetic tool core with two tool ends surrounded by a tool winding; and a transmitting activation tool at a well surface proximate to a subterranean wellbore, the transmitting activation tool including a magnetic activator core with two activator ends surrounded by an activator winding, the activator ends proximate the tool ends to generate a triggering signal from a magnetic field that transitions the receiving tool from an inactive state to an active state prior to the receiving tool being placed in the subterranean wellbore.

2. The system of claim 1, wherein:

the receiving tool comprises a power supply and an electrical load; and in the inactive state, a circuit is incomplete and current flow between the power supply and the electrical load is disallowed.

3. The system of claim 2, wherein in the active state, the circuit is complete and current flow between the power supply and the electrical load is allowed.

4. The system of claim 2, wherein the receiving tool further comprises a switching system including:

a rectifier portion configured to convert the triggering signal generated by the magnetic field to a rectified signal;

a triggering portion configured to receive the rectified signal; and a power switching portion configured to be activated by the triggering portion.

5. The system of claim 4, wherein the triggering portion comprises an electronic switch configured to activate the power switching portion upon experiencing a voltage change at an input terminal by providing an electrical current path between the power supply and the electrical load.

6. The system of claim 1, wherein the receiving tool and the transmitting activation tool are oriented perpendicular to a length of the wellbore tubular.

7. The system of claim 1, wherein the receiving tool and the transmitting activation tool are oriented parallel to a length of the wellbore tubular.

8. The system of claim 1, wherein the tool winding is made of ceramic.

9. The system of claim 1, wherein the receiving tool is configured to transmit a signal indicating a status of the receiving tool.

10. A tool method comprising:

positioning a transmitting activation tool at a well surface proximate to the subterranean wellbore and proximate to a receiving tool located in a wellbore tubular and including a magnetic tool core with two tool ends surrounded by a tool winding, the transmitting activation tool including a magnetic activator core with two activator ends surrounded by an activator winding;

generating a triggering signal from a magnetic field between the activator ends and the tool ends; and transitioning the receiving tool from an inactive state to an active state in response to the triggering signal.

11. The method of claim 10, wherein the receiving tool comprises a power supply and an electrical load; and wherein in the inactive state, a circuit is incomplete and current flow between the power supply and the electrical load is disallowed.

12. The method of claim 11, wherein in the active state, the circuit is complete and current flow between the power supply and the electrical load is allowed.

13. The method of claim 11, wherein the receiving tool further comprises a switching system including:

a rectifier portion configured to convert the triggering signal generated by the magnetic field to a rectified signal;

a triggering portion configured to receive the rectified signal; and a power switching portion configured to be activated by the triggering portion.

14. The method of claim 13, wherein the triggering portion comprises an electronic switch configured to activate the power switching portion upon experiencing a voltage change at an input terminal by providing an electrical current path between the power supply and the electrical load.

15. The method of claim 10, wherein the receiving tool and the transmitting activation tool are oriented perpendicular to a length of the wellbore tubular.

16. The method of claim 10, wherein the receiving tool and the transmitting activation tool are oriented parallel to a length of the wellbore tubular.

17. The method of claim 10, wherein the tool winding is made of ceramic.

18. The method of claim 10, further comprising transmitting a signal from the receiving tool indicating a status of the receiving tool.

19. The method of claim 10, further comprising lowering the receiving tool into the subterranean wellbore.

* * * * *